US008141660B2

(12) United States Patent
Furuki

(10) Patent No.: US 8,141,660 B2
(45) Date of Patent: Mar. 27, 2012

(54) EXCAVATOR APPARATUS FOR UNDERGROUND EXCAVATION

(76) Inventor: Kazunori Furuki, Kumamoto (JP)

( * ) Notice: Subject to any disclaimer, the term of this patent is extended or adjusted under 35 U.S.C. 154(b) by 279 days.

(21) Appl. No.: 12/517,452

(22) PCT Filed: Nov. 29, 2007

(86) PCT No.: PCT/JP2007/073036

§ 371 (c)(1),
(2), (4) Date: Jun. 3, 2009

(87) PCT Pub. No.: WO2008/069089

PCT Pub. Date: Jun. 12, 2008

(65) Prior Publication Data

US 2010/0018774 A1 Jan. 28, 2010

(30) Foreign Application Priority Data

Dec. 4, 2006 (JP) ..... 2006-327638
Dec. 4, 2006 (JP) ..... 2006-327639

(51) Int. Cl.
*E21B 1/24* (2006.01)
*E21B 4/14* (2006.01)

(52) U.S. Cl. ..... 175/65; 175/96; 175/107

(58) Field of Classification Search ..... 175/96, 175/107, 267, 414, 418, 296, 415, 338; 251/88, 251/207, 208; 137/595, 87.01, 87.06
See application file for complete search history.

(56) References Cited

U.S. PATENT DOCUMENTS 1,585,740 A * 5/1926 Saulia ..... 173/52
4,883,133 A * 11/1989 Fletcher et al. ..... 175/93
5,417,083 A * 5/1995 Eber ..... 62/528

FOREIGN PATENT DOCUMENTS

| | | | |
|---|---|---|---|
| JP | 61-092288 | A | 5/1986 |
| JP | 06-084717 | B2 | 10/1994 |
| JP | 09-328983 | A | 12/1997 |
| JP | 2000-199393 | A | 7/2000 |
| JP | 3425390 | B2 | 5/2003 |
| JP | 3721381 | B1 | 11/2005 |
| JP | 3721381 | B1 * | 11/2005 |
| KR | 1020050011865 | A | 1/2005 |

* cited by examiner

*Primary Examiner* — David Bagnell
*Assistant Examiner* — Jacob Hall
(74) *Attorney, Agent, or Firm* — Leason Ellis LLP.

(57) ABSTRACT

An excavator for underground excavating arranged to perform excavating work with low vibration and low noise. A rotary excavator and an underground excavating method are also provided. The excavator (1) for underground excavating comprises a plurality of bits (42*a*, . . . ) having the outside diameter smaller than that of the excavator body (2) and advancing/retracting to/from the excavating side, piston case members (22*b*, . . . ) incorporating pistons (61) for applying a hitting force to respective bits (42*a*, . . . ) by the energy of working fluid, a section (30) for storing the working fluid being fed to respective piston case members (22*b*, . . . ), working fluid circulation passages (352) for allowing the working fluid being fed to respective piston case members (22*b*, . . . ) to pass, and a body of rotation (40) provided with a plurality of holes (4*a*, . . . ) for allowing the fluid storage section (30) to communicate with the circulation openings (3*a*, . . . ) of each working fluid circulation passage (352) in order to feed the working fluid from the fluid storage section (30) to the circulation openings (3*a*, . . . ) of the respective working fluid circulation passages (352).

9 Claims, 17 Drawing Sheets

EXCAVATOR APPARATUS FOR UNDERGROUND EXCAVATION

CROSS REFERENCE TO RELATED APPLICATIONS

This is a U.S. national phase application under 35 U.S.C. §371 of International Patent Application No. PCT/JP2007/073036 filed Nov. 29, 2007 and claims the benefit of Japanese Application No. 2006-327638 filed Dec. 4, 2006 and Japanese Application No. 2006-327639 also filed Dec. 4, 2006. The International Application was published in the Japanese language on Jun. 12, 2008 as International Publication No. WO/2008/069089 under PCT Article 21(2). The contents of all foregoing applications are incorporated herein in their entireties.

FIELD OF THE INVENTION

The present invention relates to an excavating apparatus for underground excavation, a rotary excavator, and an underground excavating method.

In greater detail, the present invention relates to an excavating apparatus for underground excavation, a rotary excavator, and an underground excavating method that can perform excavation work with low levels of vibration and noise.

RELATED ART

In the fields of civil engineering and construction, excavating apparatuses called "down-the-hole hammers" are used in the excavation of hard soil foundations that principally contain, for example, bedrock, boulders, concrete, and the like. A down-the-hole hammer supplies compressed air to drive an internal piston, which moves a hammer bit at the tip up and down, and excavation is performed by the resulting strikes (e.g., refer to Japanese Unexamined Patent Application Publication No. H9-328983 (hereinafter "JP '983", please refer to FIG. 1 thereof).

In addition, excavating apparatuses called "earth augers" that excavate holes using a helical cone are also used; however, compared with the abovementioned down-the-hole hammer, an earth auger is not as well suited to the excavation of a hard soil foundation that contains, for example, bedrock, boulders, or concrete.

In a conventional down-the-hole hammer as shown in FIG. 1 of JP '983, the soil foundation is struck by moving a hammer bit, whose diameter is substantially the same as that of the hole to be excavated, up and down; consequently, the impact to which the soil foundation is subjected with every strike is large, which generates intense noise and vibrations during excavation. Consequently, the conventional down-the-hole hammer is not suited for use in, for example, dense residential areas and urban business districts where it is preferable to perform work with low levels of vibration and noise.

Thus, in locations where it is highly desirable to perform work with low levels of vibration and noise, preventing the generation of noise and vibration becomes one of the most important goals; however, even in locations where the generation of some vibration and noise is not an impediment (e.g., locations somewhat distant from any dense residential area or business districts), it is nevertheless important to increase the efficiency of the excavation work and to reduce the number of construction workdays. Namely, while reducing the number of construction workdays reduces costs, it also reduces the number of days during which the area surrounding the site is exposed to vibration and noise.

Accordingly, an object of the present invention is to provide an excavating apparatus for underground excavation, a rotary excavator, and an underground excavating method wherein excavation work can be performed with low levels of vibration and noise.

Another object of the present invention is to provide an excavating apparatus for underground excavation, a rotary excavator, and an underground excavating method, wherein excavation work can be performed both with low levels of vibration and noise, and, by increasing the efficiency of the excavation work, over fewer construction workdays. This and other objects of the present invention will become obvious in the course of the explanation below.

SUMMARY OF THE INVENTION

The means devised by the present invention to achieve the abovementioned objects are as below.

Furthermore, while including in parenthesis reference numerals used in the drawings aid in understanding the explanation of the operation (discussed later), the constituent features are not limited to those symbols used in the drawings.

The present invention provides an excavating apparatus for underground excavation that includes: a plurality of bits, the outer diameters of which are smaller than that of an excavating apparatus main body, that advances to and retracts from an excavation side; piston case members, which correspond to the number of the bits and a plurality of which are housed inside the excavating apparatus main body, with built-in pistons that impart strike forces to the bits via the energy of a working fluid; a fluid storage part that stores the working fluid that is fed to each of the piston case members; working fluid distribution paths, a plurality of which are provided corresponding to the number of the piston case members, wherethrough the working fluid fed to each of the piston case members passes; and a rotary body that comprises a plurality of communication holes, which brings the fluid storage part and distribution ports into communication in order to feed the working fluid from the fluid storage part to the distribution ports of the working fluid distribution paths; wherein, the distribution ports are provided in the rotational direction of the rotary body such that the bits are impact driven staggered in time; and the communication holes are provided in the rotational direction with a layout different from that of the distribution ports in order to prevent each of the communication holes from communicating with each of the distribution ports simultaneously and with the same degree of openness.

The present invention may be configured such that the rotary body comprises a working fluid receiving blade for catching the working fluid and thereby rotating the rotary body.

The present invention may be configured such that the rotary body comprises working fluid supply holes that, separately from the communication holes, bring the fluid storage part and each of the distribution ports into communication; and the working fluid supply holes are set such that their inner diameters are smaller than those of the communication holes in order to supply part of the working fluid needed to impart the strike forces to the bits.

The present invention can include: a plurality of bits that are impact driven simultaneously separately and independently of the plurality of the bits that are impact driven staggered in time; wherein, the working fluid distribution paths of piston case members that correspond to the separately and independently driven bits are in a state of continuous communication with the fluid storage part without being controlled by the rotary body.

In addition, the present invention provides an excavating apparatus for underground excavation that has: a plurality of bits, the outer diameters of which are smaller than that of an excavating apparatus main body, that advances to and retracts from an excavation side; piston case members, which correspond to the number of the bits and a plurality of which are housed inside the excavating apparatus main body, with built-in pistons that impart strike forces to the bits via the energy of a working fluid; a fluid storage part that stores the working fluid that is fed to each of the piston case members; and working fluid distribution paths, a plurality of which are provided corresponding to the number of the piston case members, wherethrough the working fluid fed from the fluid storage part to each of the piston case members passes; wherein, at least one aspect selected from the group consisting of the distance of travel of the pistons (61) that move reciprocatively in order to impart strike forces to the bits, the sizes of the pistons, and the weights of the pistons, are set differently for each of the piston case members such that the bits, which are provided to the piston case members, are impact driven staggered in time.

Furthermore, the present invention provides an excavating apparatus for underground excavation that includes: a plurality of bits, the outer diameters of which are smaller than that of an excavating apparatus main body, that advances to and retracts from an excavation side; piston case members, which correspond to the number of the bits and a plurality of which are housed inside the excavating apparatus main body, with built-in pistons that impart strike forces to the bits via the energy of a working fluid; a fluid storage part that stores the working fluid that is fed to each of the piston case members; and working fluid distribution paths, a plurality of which are provided corresponding to the number of the piston case members, wherethrough the working fluid fed from the fluid storage part to each of the piston case members passes; wherein, the internal diameters of working fluid distribution paths, wherethrough the working fluid passes, are set differently for each of the piston case members such that the bits, which are provided to the piston case members, are impact driven staggered in time.

The present invention may be configured such that the fluid storage part is provided with a working fluid guide member that catches the working fluid supplied by the fluid storage part and guides such to the distribution ports.

The present invention may be configured such that the excavating apparatus main body is provided with vibration isolating and/or sound insulating materials such that they surround the piston case members.

The present invention is a rotary excavator that has: an excavating apparatus according to any one aspect of the abovementioned aspects; and a rotary drive apparatus that is capable of imparting rotary motion to the excavating apparatus.

Furthermore, the present invention is an underground excavating method wherein an excavating apparatus according to any one aspect of the abovementioned aspects is used, and includes the step of: performing underground excavation while imparting rotary motion to the excavating apparatus.

A gas, such as air (e.g., compressed air) or a liquid, such as water or oil, can be used as the "working fluid" recited in the present specification and the claims.

The number of distribution ports of the working fluid distribution paths provided in the rotational direction of the rotary body and the number of the communication holes of the rotary body may be the same or different (e.g., greater or lesser), as long as it is possible to prevent the communication holes and the distribution ports from communicating simultaneously and with the same degree of openness.

The cases listed below are examples of layouts of the communication holes and the distribution ports that can prevent the communication holes from communicating with the distribution ports simultaneously and with the same degree of openness.

If the number of the communication holes and the number of the distribution ports are the same, then either the communication holes or the distribution ports may be disposed equispaced, while the others are disposed not equispaced but rather with staggered spacing. In addition, both may be disposed not equispaced but rather with staggered spacing. Furthermore, if the number of the communication holes and the number of distribution ports are different, then there are cases wherein, depending on those numbers, both may be disposed equispaced. For example, in the case wherein the distribution ports are provided equispaced at five locations in the rotational direction of the rotary body and the communication holes are provided at six locations, then, even if the communication holes were disposed equispaced, it is still possible to prevent the communication holes from communicating with the distribution ports simultaneously and with the same degree of openness.

There are also cases wherein either the vibration isolating material or the sound insulating material is included in the "vibration isolating and/or sound insulating material" recited in the present specification and the claims, as well as cases wherein both the vibration isolating material and the sound insulating material are included (i.e., a material provided with both functions—vibration isolation and sound insulation—is included).

The excavating apparatus for underground excavation according to the present invention has a plurality of multiple bits whose outer diameters are smaller than that of the excavating apparatus main body, that advance to and retract from the excavation side, and that operate as follows.

(a) The rotation of the rotary body brings the fluid storage part and the distribution ports of the working fluid piston paths into communication via the plurality of communication holes, which are provided to the rotary body. Thereby, the working fluid is fed from the fluid storage part to each of the working fluid piston paths. As a result, the pistons, which are built into the piston case members, impart strike forces to the bits, which advance and retract to the excavation side of the excavating apparatus main body; thereby, excavation is performed.

Furthermore, in the present invention, the distribution ports are provided in the rotational direction of the rotary body such that the distribution ports can communicate with the communication holes, and, to prevent the communication holes from communicating with the distribution ports simultaneously and with the same degree of openness, the communication holes are provided in a layout different from that of the distribution ports. Thereby, it is possible to prevent the working fluid from being fed simultaneously and at the same flow rate from the fluid storage part to the piston case members. As a result, the bits are impact driven staggered in time. Accordingly, the impact on the soil foundation received for each strike of the bits is small.

(b) By providing the rotary body with working fluid receiving blades that catch the working fluid and thereby rotate the rotary body, the rotary body itself rotates without the addition of any other motive power. Consequently, it is possible to prevent problems such as complicating the structure or increasing the number of parts as in cases wherein other types of motive power are provided.

(c) The rotary body includes the working fluid supply holes, which bring the fluid storage part and the distribution ports into communication separately from the communication holes; consequently, attendant with the rotation of the rotary body, the working fluid is fed from the fluid storage part to the distribution ports via the working fluid supply holes, whose inner diameters are smaller than those of the communication holes, and the pistons move as far as the standby state prior to imparting the strike forces to the bits. Thereby, when the communication holes communicate with the distribution ports, the bits are impact driven promptly, and thus excavation is performed smoothly.

(d) A plurality of bits are provided, separately and independently of the plurality of bits that are impact driven staggered in time, that are impact driven simultaneously, and therefore the plurality of bits that are impact driven simultaneously can simultaneously impart a large impact force to the earth surface, yielding a high excavation working efficiency compared with the case wherein all of the bits are impact driven staggered in time.

(e) The working fluid is fed from the fluid storage part, which stores the working fluid, to the piston case members via the working fluid piston paths. Thereby, the pistons built into the piston case members impart strike forces to the bits for the purpose of excavation.

Furthermore, in the present invention, at least one aspect selected from the group including the distance of travel of the piston that moves reciprocatively to impart a strike force to the bit, the size of the piston, and the weight of the piston, is set differently for each of the piston case members, or the inner diameter of the working fluid paths through which the working fluid passes is set differently for each of the piston case members; therefore, by setting other conditions of the piston case members identically, the bits are impact driven staggered in time. Accordingly, the impact on the soil foundation received for each strike of the bits is small.

(f) By providing the working fluid guide member to the fluid storage part, the working fluid guide member catches the working fluid supplied by the fluid storage part and guides such to the distribution ports; thereby, the working fluid is fed uniformly, or uniformly to the degree possible, to each of the communication holes of the rotary body. In addition, the working fluid guide member catches the working fluid supplied by the fluid storage part and guides such to the working fluid paths; thereby, the working fluid is fed uniformly, or uniformly to the degree possible, to each of the working fluid paths. Thereby, it is possible to prevent nonuniformity in the working fluid that is fed to each of the piston case members and, as a result, to make the impact forces of each of the bits identical or identical to the degree possible; thereby, the excavation surface can be struck uniformly.

(g) In being provided to the excavating apparatus main body such that it surrounds the piston cases, the vibration isolating and/or sound insulating material mitigates the vibration and the sound generated when the pistons are driven.

(h) The rotary excavator according to the present invention performs excavation work while the rotary drive apparatus imparts rotary motion to the excavating apparatus. Through the imparting of this rotary motion, the excavation positions of the bits of the excavating apparatus move with respect to the excavation surface. Thereby, the bits strike the entire excavation surface without missing any spots.

The present invention has the abovementioned configuration and the effects described below.

(a) According to the excavating apparatus of the present invention, at least one aspect selected from the group consisting of the distance of travel of the piston that moves reciprocatively to impart a strike force to the bit, the size of the piston, and the weight of the piston, is set differently for each of the piston case members, or the inner diameter of the working fluid paths through which the working fluid passes is set differently for each of the piston case members; therefore, by setting other conditions of the piston case members identically, the bits are impact driven staggered in time.

Thereby, the impact on the soil foundation received for each strike of the bits is small compared with the conventional down-the-hole hammer, wherein the soil foundation is struck by moving up and down a hammer bit whose diameter is substantially the same as that of the hole to be excavated; consequently, excavation work can be performed with low levels of vibration and noise. Accordingly, the present invention is suitable for use in, for example, dense residential areas and urban business districts where it is desirable to perform work at lower levels of vibration and noise.

In addition, in contrast to the conventional excavating apparatus, which requires a comparatively large air compressor, the present invention needs only to drive comparatively small bits, and therefore the amount of the working fluid (e.g., air) required for a single bit to advance and retreat is small, which enables the supply apparatus that supplies the working fluid (e.g., the air compressor when the working fluid is air) to be made more compact. Thereby, only a small installation surface area is needed for the supply apparatus, and consequently the present invention is ideally suited to construction work performed at locations where space is limited, such as dense residential areas and urban business districts. In addition, reducing the size of the supply apparatus makes it possible to make the driving means, such as the engine that drives the supply apparatus, more compact; consequently, it is possible to reduce the levels of vibration and noise generated by the driving means.

(b) By providing the rotary body with working fluid receiving blades that catch the working fluid and thereby rotate the rotary body, the rotary body itself rotates without the addition of any other motive power; consequently, it is possible to prevent problems such as complicating the structure or increasing the number of parts as in cases wherein other types of motive power are provided.

(c) The rotary body includes working fluid supply holes, which bring the fluid storage part and the distribution ports into communication separately from the communication holes, and therefore the bits can be impact driven promptly; consequently, the excavation work can be performed smoothly.

(d) A plurality of bits are provided, separately and independently of the bits that are impact driven staggered in time, that are impact driven simultaneously, and therefore the plurality of bits that are impact driven simultaneously can simultaneously impart a large impact force to the earth surface, yielding a high excavation working efficiency. In addition, also provided are the plurality of bits that are impact driven staggered in time, which, compared with the case wherein all of the bits are impact driven staggered in time, makes it possible to reduce the number of construction work days needed to perform the excavation work.

(e) The working fluid guide member is provided to the fluid storage part, and therefore it is possible to prevent nonuniformity in the working fluid that is fed to each of the piston case members; consequently, the impact forces of every bit are made identical, or identical to the degree possible, and the excavation surface can be struck evenly.

(f) The excavating apparatus main body is provided with a vibration isolating and/or sound insulating material that surrounds the piston cases, which makes it possible to effectively prevent the leakage or external transmission of the vibration or the sound generated when the pistons are driven.

(g) According to the rotary excavator and the underground excavating method of the present invention, using the excavating apparatus, which has the effects mentioned above, while imparting rotary motion thereto makes it possible to perform excavation work at low levels of vibration and noise.

DETAILED DESCRIPTION OF THE INVENTION

The following text explains the present invention based on the various embodiments, but the present invention is not limited thereto.

FIG. 1 through FIG. 9 are views for explaining an embodiment of an excavating apparatus for underground excavation according to the present invention.

Figure 1:
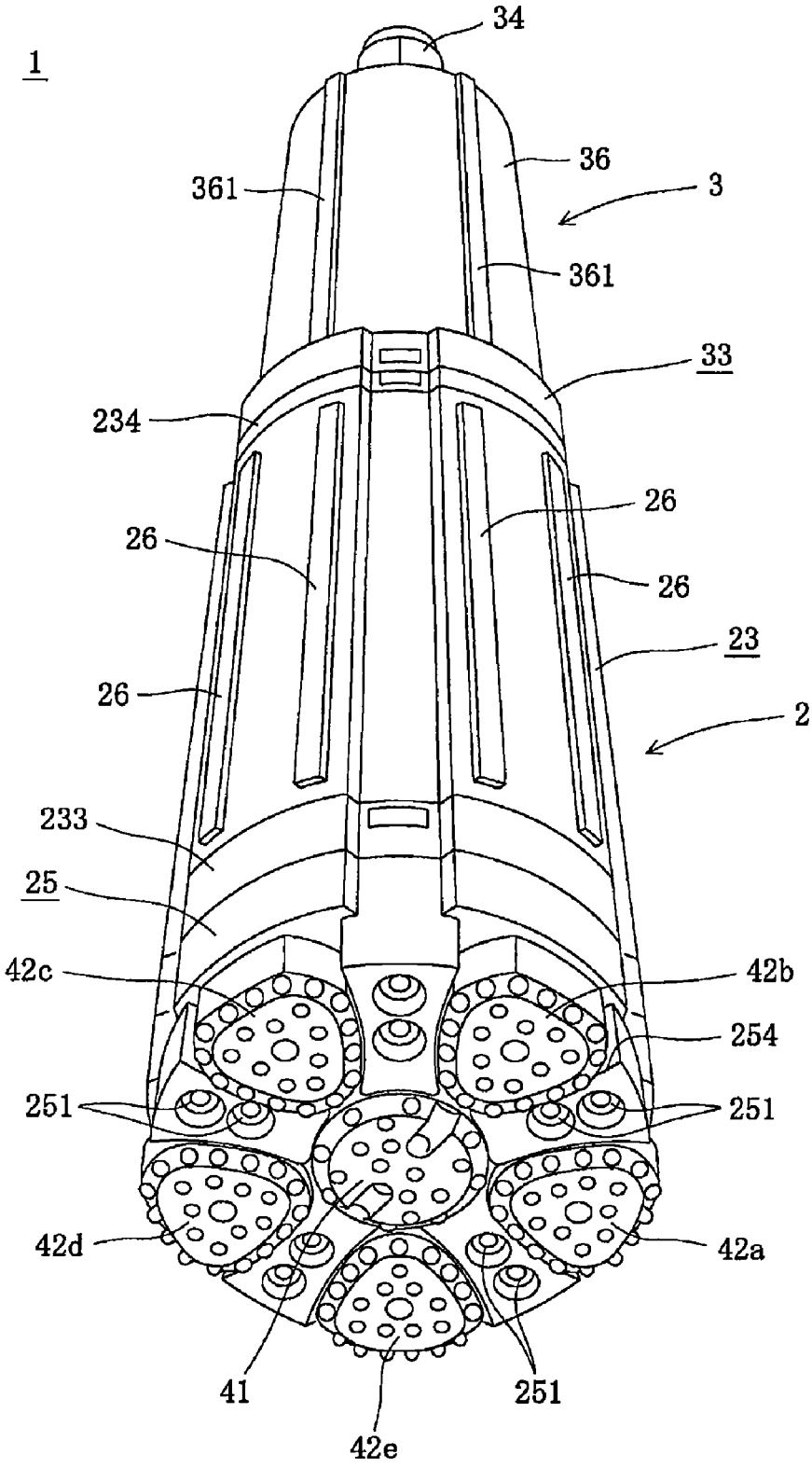
FIG. 1 is an explanatory oblique view of an excavating apparatus according to an embodiment, viewed from a tip side.
Figure 2:
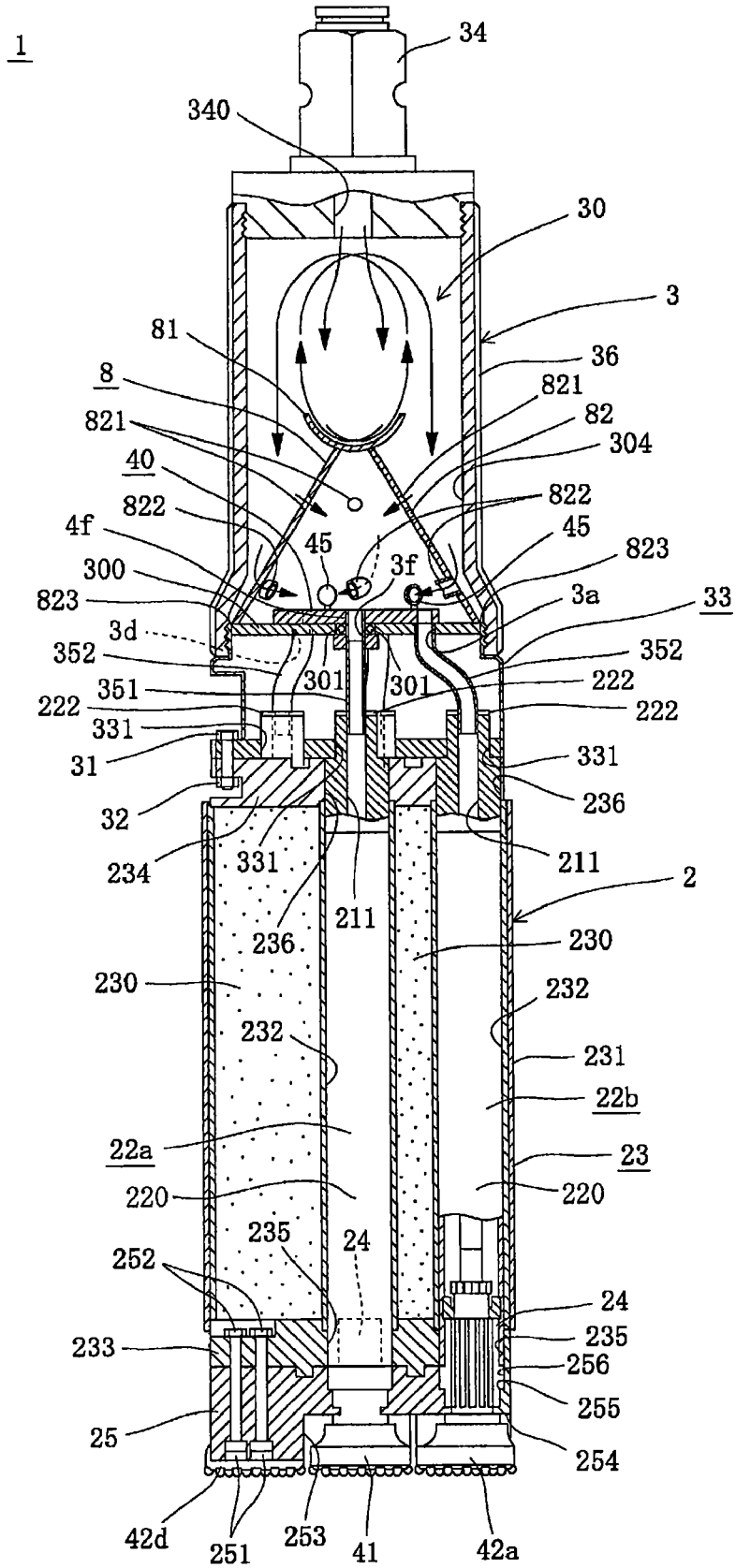
FIG. 2 is an explanatory longitudinal cross sectional view of the excavating apparatus shown in FIG. 1.
Figure 3:
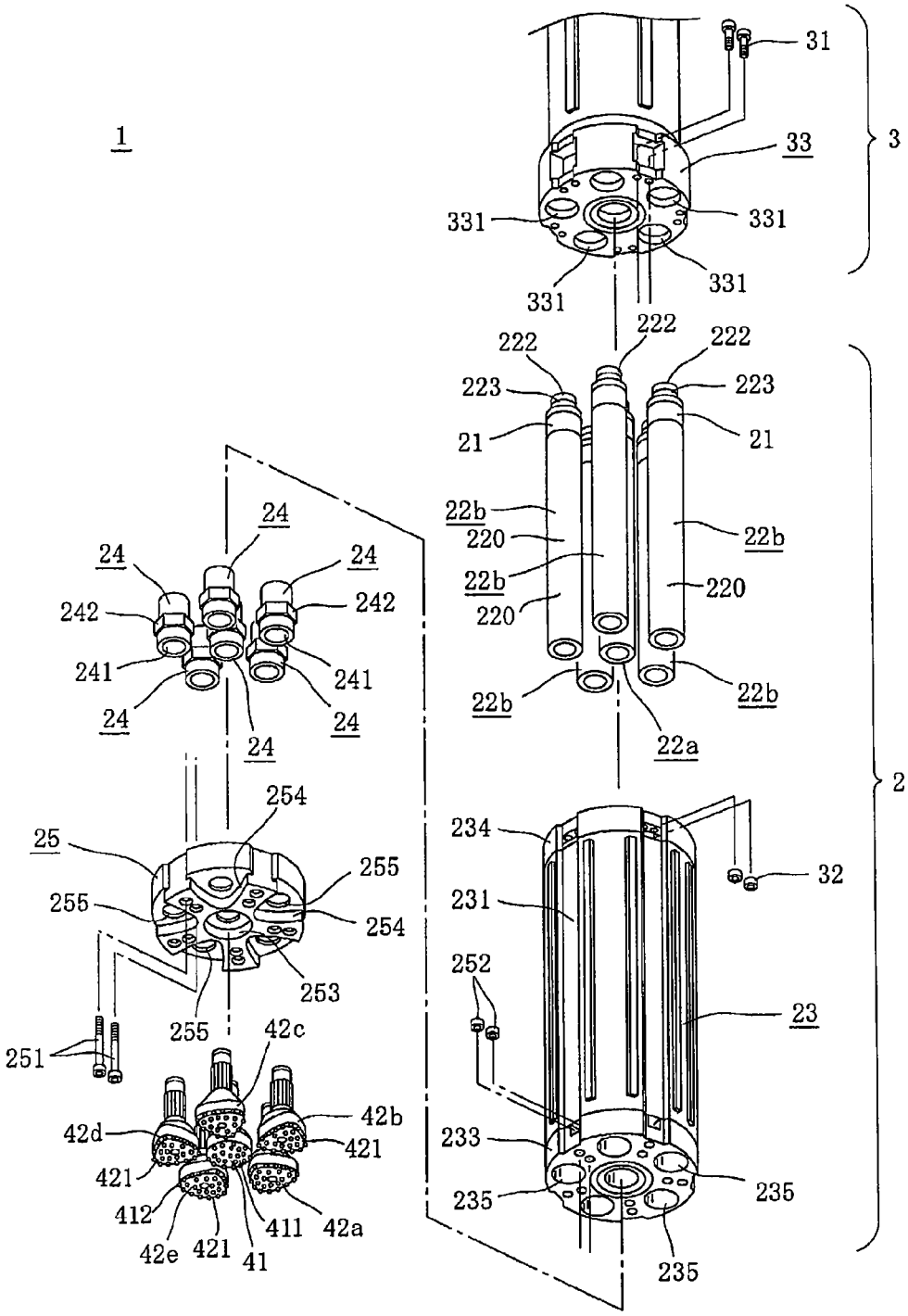
FIG. 3 is an explanatory exploded oblique view of the excavating apparatus shown in FIG. 1.

FIG. 1 is an explanatory oblique view of the excavating apparatus according to the embodiment, viewed from a tip side; FIG. 2 is an explanatory longitudinal cross sectional view of the excavating apparatus shown in FIG. 1; and FIG. 3 is an explanatory exploded oblique view of the excavating apparatus shown in FIG. 1 that shows an air tank member as well as an excavating bit member that has been removed from the air tank member. Furthermore, a base side (i.e., the upward side) of an air tank member 3 is not shown in FIG. 3.

Figure 4:
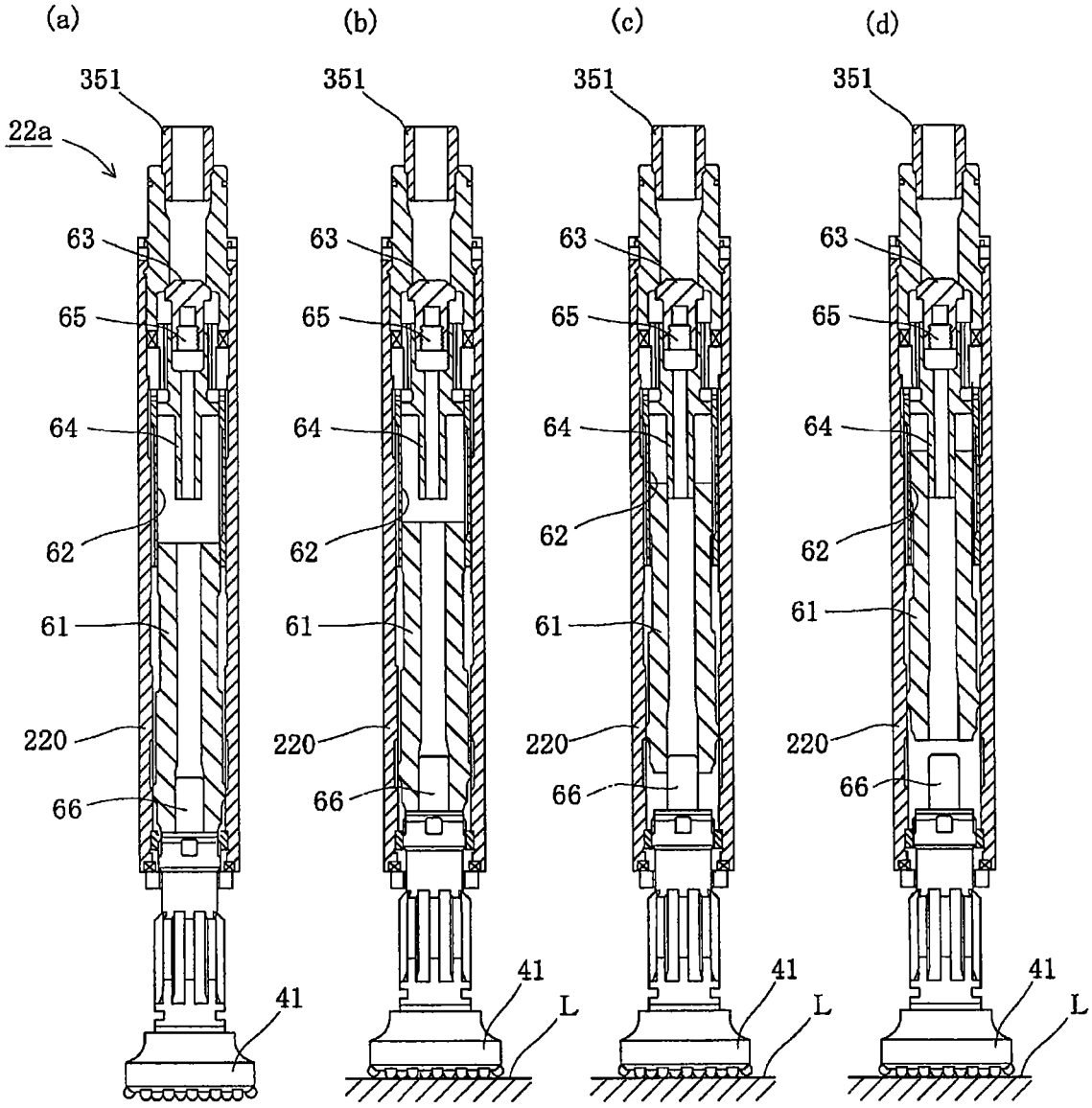
FIG. 4 includes explanatory side views that show the internal structure of a longitudinal cross section of the piston case member, which is housed in an excavating bit member.

FIG. 4 is an explanatory side view that shows the internal structure of a longitudinal cross section of a piston case member, which is housed in the excavating bit member, wherein FIGS. 4(*a*)-(*d*) show the states wherein the built-in piston moves up and down (i.e., undergoes advancing and retracting movement) over the course of time.

Figure 5:
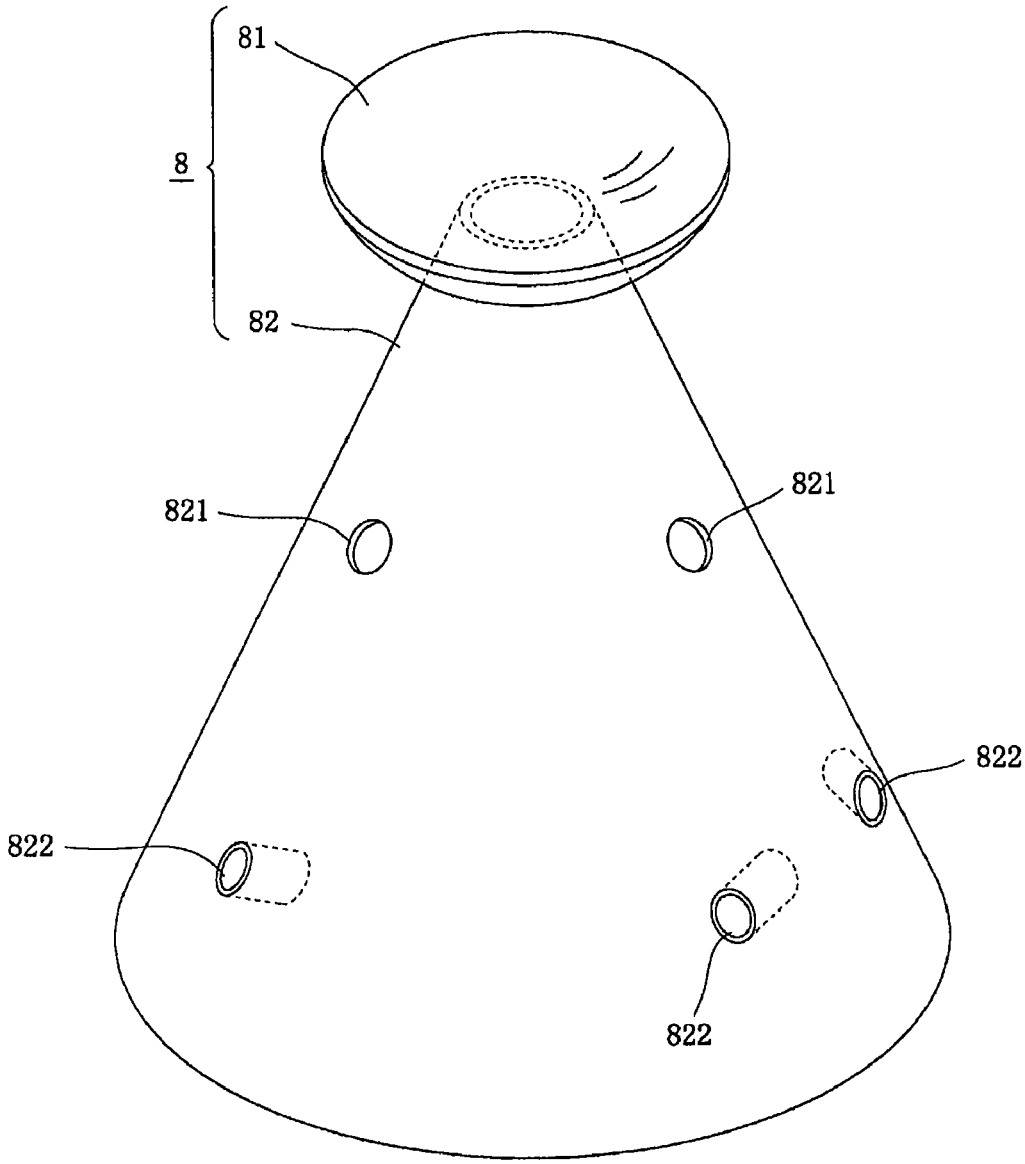
FIG. 5 is an explanatory oblique view that shows a fluid guide member, which is disposed inside an air tank member of the excavating apparatus shown in FIG. 2.
Figure 6:
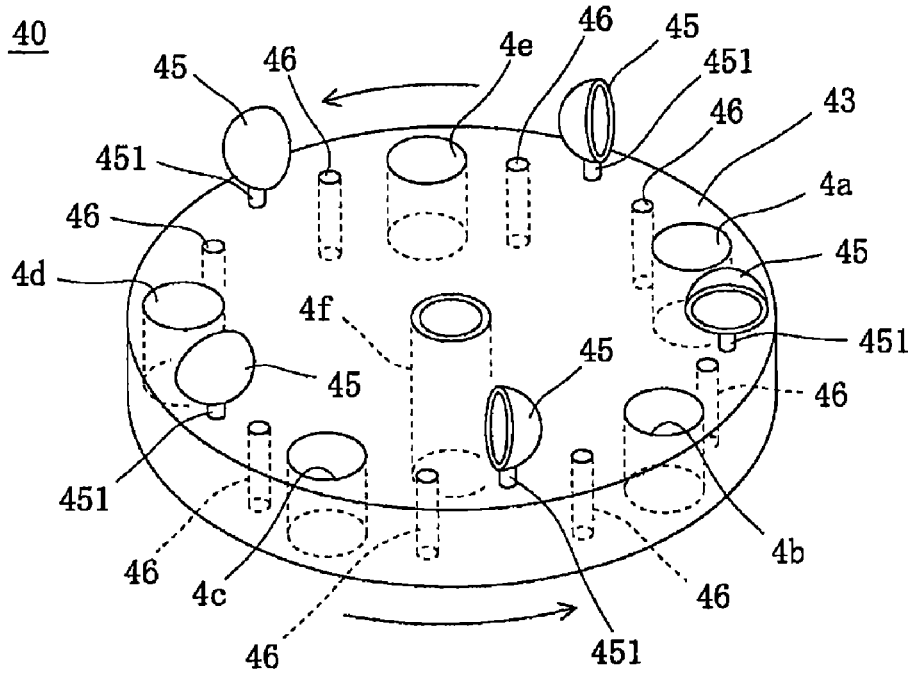
FIG. 6 is an explanatory oblique view that shows a rotary body, which is disposed inside the fluid guide member shown in FIG. 5.
Figure 7:
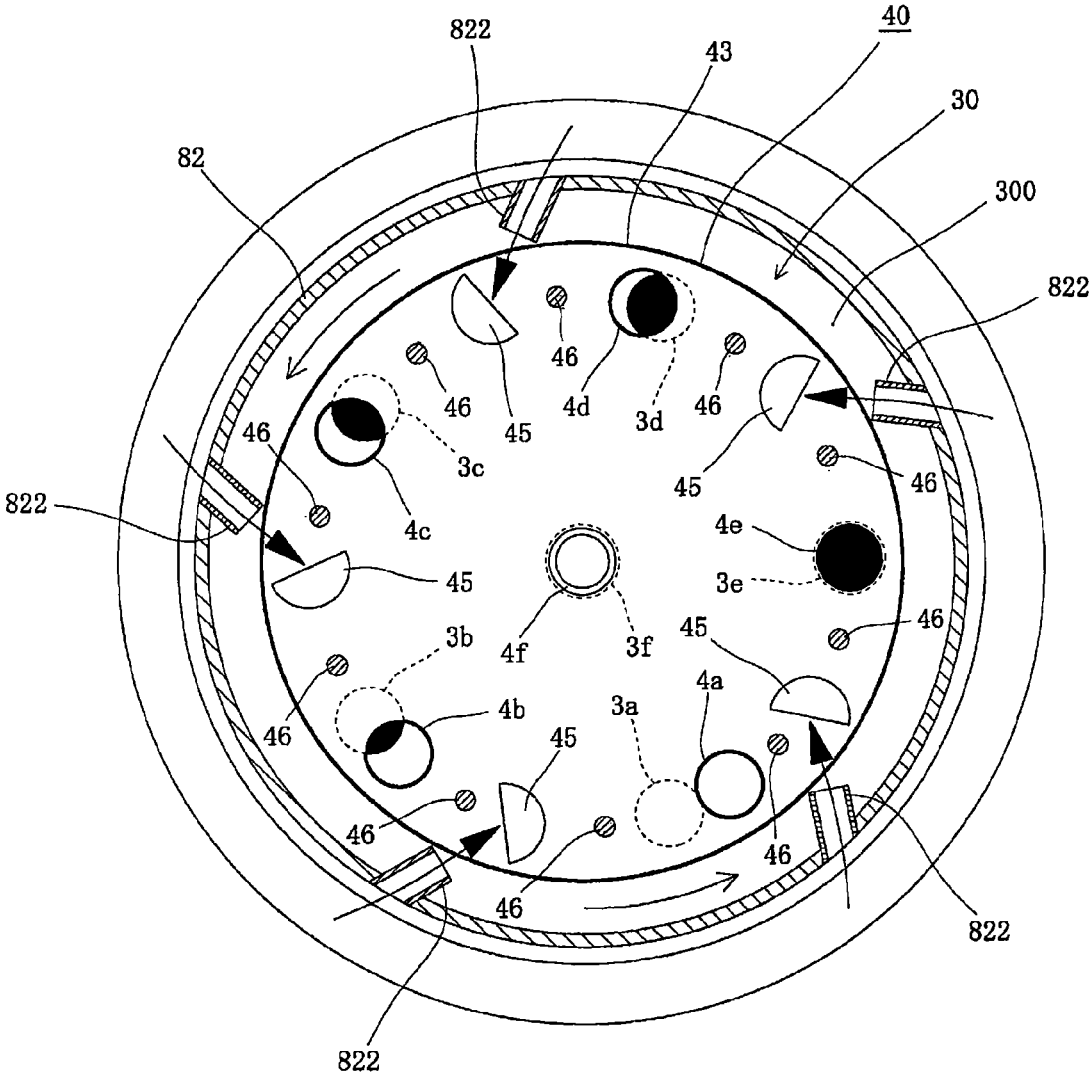
FIG. 7 is an explanatory plan view that shows the internal structure of the fluid guide member, including the rotary body, shown in FIG. 5, with the cross section taken in the horizontal directions.

FIG. 5 is an explanatory oblique view that shows a fluid guide member, which is disposed inside the air tank member of the excavating apparatus shown in FIG. 2. FIG. 6 is an explanatory oblique view that shows a rotary body, which is disposed inside the fluid guide member shown in FIG. 5. FIG. 7 is an explanatory plan view that shows the internal structure, including the rotary body, of the fluid guide member shown in FIG. 5, such that the cross section is taken in the horizontal directions; and FIGS. 8(*a*)-(*d*) are explanatory partial schematic views that show the rotating states of the rotary body shown in FIG. 7 over the course of time, wherein FIG. 8(*a*) corresponds to the state shown in FIG. 7. Furthermore, air catching blades 45 and air supply holes 46, which are shown in FIG. 7, are not shown in FIG. 8.

Figure 9:
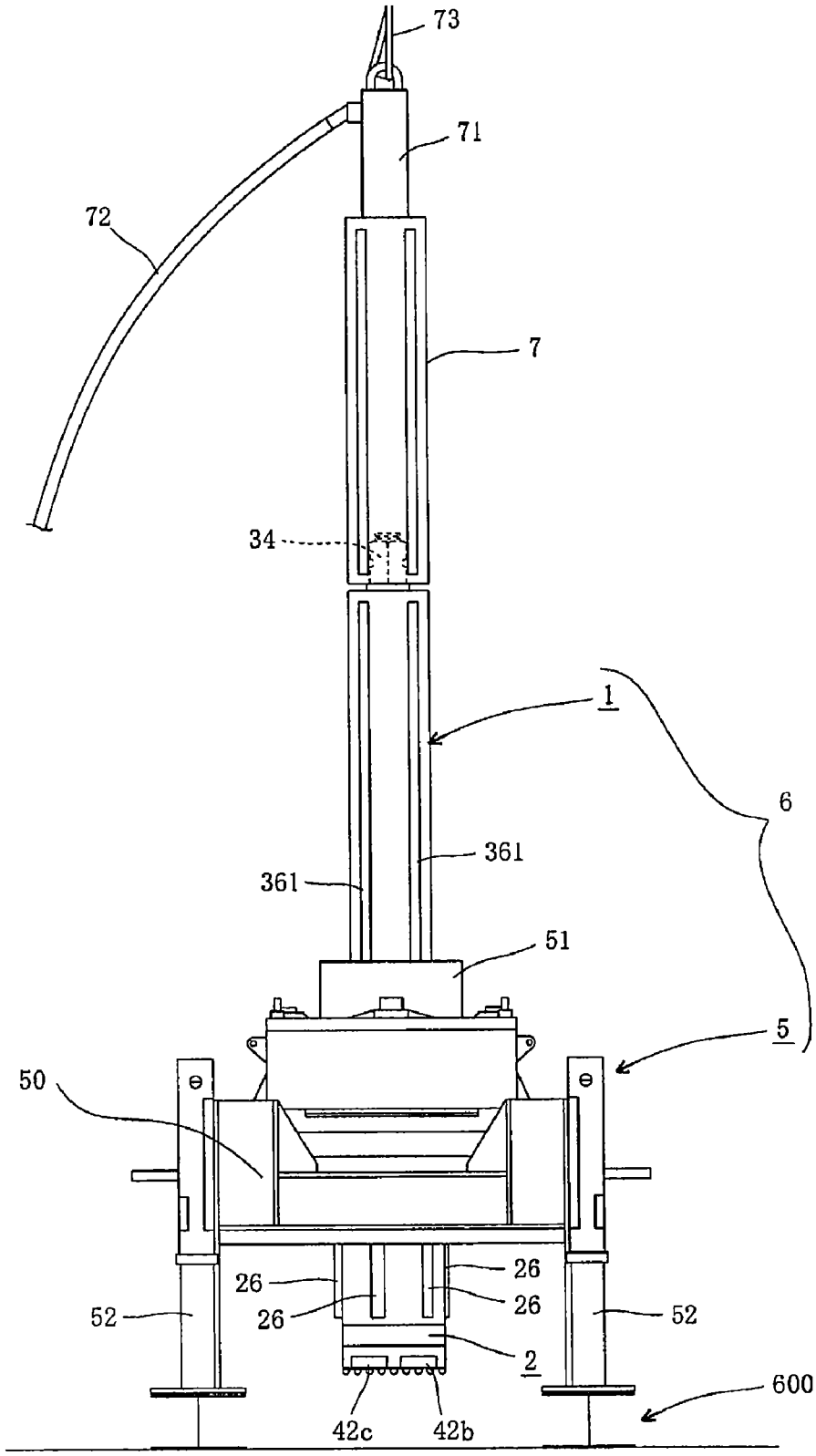
FIG. 9 is an explanatory side view that shows a rotary excavator that principally comprises the excavating apparatus and a rotary drive apparatus.

FIG. 9 is an explanatory side view that shows a rotary excavator, which principally includes the excavating apparatus and a rotary drive apparatus.

As shown in FIG. 9, a rotary excavator 6 comprises an excavating apparatus 1 for underground excavation, which is shown in FIG. 1, and a rotary drive apparatus 5, which can provide rotary motion to the excavating apparatus 1.

First, the excavating apparatus 1 will be explained, and then the rotary drive apparatus 5 will be explained.

Excavating Apparatus 1

As shown in FIG. 1 and FIG. 2, the excavating apparatus 1 is formed such that its overall shape is substantially columnar. The excavating apparatus 1 comprises an excavating bit member 2, which is an excavating apparatus main body positioned on the excavation side (i.e., the tip side), and an air tank member 3, which is a working fluid storage member positioned on the base side.

The excavating bit member 2 comprises, at its tip, a plurality of bits 41, 42*a*, 42*b*, 42*c*, 42*d*, 42*e* (in the present embodiment, six). Each of the plurality of bits 41, 42*a*, . . . is smaller than the excavating bit member 2. As shown in FIG. 9 (discussed below), the excavating apparatus 1 is suspended from a crane (not illustrated), and thereby is used in an erect state such that each of the bits 41, 42, . . . at the tip face downward.

In the present embodiment, as shown in FIG. 1, the bits 41, 42*a*, . . . include: the center bit 41, which is provided at one location on a shaft center part of the excavating bit member 2, and the peripheral bits 42*a*, 42*b*, 42*c*, 42*d*, 42*e*, which are provided at five locations equispaced along a circumference of which the center bit 41 serves as the center (i.e., equispaced around the center bit 41). As discussed below, whereas the head part of the center bit 41 is circular, the head part of each of the peripheral bits 42*a*, . . . is substantially triangular.

The peripheral bits 42*a*, . . . are not impact driven simultaneously; rather, they are configured such that each is impact driven staggered in time. In contrast, the center bit 41 is impact driven separately and independently of the strike operations of the other peripheral bits 42*a*, . . . .

The air tank member 3 is detachably connected to the base side of the excavating bit member 2 by bolts 31 and nuts 32, which are fastening tools (hidden in FIG. 1; refer to FIG. 2). As shown in FIG. 2, the air tank member 3 has an air storage part 30 that can store air, which constitutes the working fluid that drives the bits 41, 42*a*, . . . , under high pressure.

The following text explains in detail and in order each constituent member of the excavating apparatus 1.

(Excavating Bit Member 2)

As shown in FIG. 3, the excavating bit member 2 has, in order from above: piston case members 22*a*, 22*b*, 22*b*, 22*b*, 22*b*, 22*b*, each of which includes a connection body 21 and houses, for example, a driving means that includes a piston; a piston case mounting body 23; drive chucks 24; a chuck guide 25; and bits 41, 42*a*, . . . .

Each of the piston case members 22*a*, 22*b*, . . . has a cylindrical piston case main body 220 that is made of a metal. The connection body 21 is screwed to a base end part (in FIG. 3, an upper part) of each of the piston case main bodies 220. The bits 41, 42*a*, . . . are connected to tip parts (in FIG. 3, lower parts) of the corresponding piston case main bodies 220 via the drive chucks 24 and the chuck guide 25. The piston case members 22*a*, 22*b* are provided in the same number as the bits 41, 42*a*, . . . (in the present embodiment, a plurality at a total of six locations).

Furthermore, for the sake of convenience in the explanation below, the piston case member 22*a* corresponding to the center bit 41 is sometimes called the "center piston case member 22*a*," and the piston case members 22*b* corresponding to the peripheral bits 42*a*, . . . are sometimes called the "peripheral piston case members 22*b*."

We now refer to FIG. 4 which shows the singular center piston case member 22*a* that is housed in the excavating bit member, but the other peripheral piston case members 22*b* have substantially the same structure, differing only in the shape of the bit 41, and all pistons 61 perform reciprocating motion in the same manner.

As shown in FIG. 4, a driving means, which includes the piston 61 that operates the bit 41, is built into (housed in) the piston case main body 220. Namely, in addition to the piston 61, the piston case main body 220 is provided with a cylinder 62, a check valve 63, an air distributor 64 (i.e., a rigid valve), a valve spring 65, a foot valve 66, a make-up ring, an O-ring, a piston retainer ring, and a bit retainer ring. This driving means is the same as or substantially the same as the drive mechanism of the well known down-the-hole hammer (e.g., as recited in Japanese Unexamined Patent Application Publication No. S61-92288), and a detailed explanation thereof is therefore omitted.

The drive mechanism will now be explained in simple terms, referencing FIGS. 4(*a*)-(*d*).

First, in the state wherein the excavating apparatus 1 is suspended prior to the excavation work as shown in FIG. 9, the bit 41 at the tip is in the state wherein it protrudes from the tip of the piston case member 22*a* owing to its own weight, as shown in FIG. 4(*a*). In this state, a tip side circumferential surface part of the piston 61 contacts an inner circumferential surface of the piston case main body 220, and the air that is introduced from an air hose 351 does not circulate (i.e., is not fed to) the tip part side of the piston 61. Thereby, the piston 61 does not rise (i.e., does not move to the base side of the piston case main body 220), and the bit 41 is in a drive stopped state.

Furthermore, as shown in FIG. 4(*b*), when the excavating apparatus 1 in the suspended state is lowered until the bit 41 makes contact with an excavation surface L, which is the earth surface (or the ground surface), the self weight of the excavating apparatus 1 causes the bit 41 to move into the interior of the piston case main body 220. Thereby, air circulates to the lower part side of the piston 61 because of a gap that is created between the tip side circumferential surface part of the piston 61 and the inner circumferential surface of the piston case main body 220 and pushes the piston 61 up at high speed, as shown in FIG. 4(*c*) as well as FIG. 4(*d*).

Subsequently, when the piston 61 rises to a required position, the tip side circumferential surface part of the piston 61 once again contacts the inner circumferential surface of the piston case main body 220, and the air no longer circulates to the tip part side of the piston 61. Thereby, the air circulates to an upper part side of the piston 61, and the piston 61 that was pushed up is now pushed down at high speed and strikes the base side of the bit 41 at the tip, as shown in FIG. 4(*a*). Thereby, the air that enters from the foot valve 66 passes through the interior of the bit 41 and is exhausted from the tip part side thereof; in addition, the bit 41 protrudes from the tip and is impact driven. The impact forces that accompany the up and down repetitive reciprocating motion of the piston 61 cause the excavation side of the bit 41 (and likewise, of the bits 42*a*, . . . corresponding to the piston case members 22*b*) to advance and retract, thereby digging into the earth.

Each of the bits 41, 42*a*, . . . vibrationally strikes (i.e., moves up and down or advances and retracts) at high speed and thereby excavates the soil foundation. For example, each bit is impact driven 1,200-1,300 times per minute, and collectively the bits are impact driven approximately 7,200-7,800 times per minute. Furthermore, even if the same excavating apparatus 1 is used, the number of strikes per unit of time varies with the hardness of the stratum to be excavated. In the case of a hard stratum, after the soil foundation is struck, the bits 41, 42*a*, . . . return quickly and the subsequent up and down movement of the piston 61 becomes intense; consequently, the number of strikes of each of the bits 41, 42*a*, . . . increases.

As shown in FIG. 2 and FIG. 3, the connection body 21 positioned at the base end part of each of the piston case main bodies 220 has a hole 211 (not visible in FIG. 3), which constitutes the path of the working fluid; furthermore, the base end side of the connection body 21 is formed in the shape of a protrusion in a cross section. That protruding portion constitutes an insertion part 222, which is mounted to the air tank member 3 by inserting it thereinto. Thus, the air that is fed from the air tank member 3 via the insertion part 222 of the connection body 21 drives the driving means inside each of the piston case members 22*a*, 22*b*.

Each of the piston case members 22*a*, 22*b*, . . . (in the present embodiment, a total of six) is detachably attached to the piston case mounting body 23 (refer to FIG. 3), which is a mounting body with a substantially columnar shape. The piston case mounting body 23 principally comprises: a tubular main body 231 (refer to FIG. 2); a cover body 233 (hereinbelow, called a "tip part cover body 233"), which is fastened to the tip part side opening of the tubular main body 231; and a cover body 234 (hereinbelow, called a "base cover body 234"), which is fastened to the base side opening of the tubular main body 231.

Furthermore, piston case casings 232 (refer to FIG. 2), which are long and thin casings with a cylindrical shape, are housed inside the piston case mounting body 23. Each of the piston case casings 232 is attached such that the corresponding piston case main body 220 is inserted therein. The piston case casings 232 number the same as the piston case main bodies 220 and are provided such that their axial directions are oriented in the longitudinal directions of the piston case mounting body 23.

The tip part cover body 233 has a required thickness and is provided with through holes 235, which are holes through which the piston case members 22 are inserted. Likewise, the base cover body 234 has a required thickness and is provided with through holes 236 (refer to FIG. 2), which are holes through which the piston case members 22*a*, 22*b* are inserted. In the present embodiment, the through holes 235 are provided at a total of six locations, namely, at one location in the center part and at five locations equispaced along the circumference whose center is the center part; likewise, the through holes 236 are provided at a total of six locations, namely, at one location in the center part and at five locations equispaced along the circumference whose center is the center part.

As shown in FIG. 2, each of the abovementioned piston case casings 232 is fastened such that it is interposed above and below by the two cover bodies 233, 234 and is housed inside the tubular main body 231. The tip side holes (symbol omitted) of the piston case casings 232 communicate with the through holes 235 of the tip part cover body 233. The base end side holes (symbol omitted) of the piston case casings 232 communicate with the through holes 236 of the base cover body 234.

Furthermore, an air gap portion formed between each of the piston case main bodies 220, 220 inside the piston case mounting body 23 (i.e., the tubular main body 231) is filled with sand 230 (refer to FIG. 2), which serves as a vibration isolating and/or sound insulating material.

In addition, the tip part of each of the piston case main bodies 220 partly protrudes from the tip part cover body 233. The base end sides of the substantially tubular drive chucks 24 shown in FIG. 3 are attached such that they are somewhat tightly pushed into holes (symbol omitted) of these protruding portions. The base sides of the bits 41, 42*a*, . . . are retractably accommodated in tip side holes 241 of the drive chucks 24 via the chuck guide 25.

The chuck guide 25 is substantially circular in a plan view, has a required thickness, and is fastened to the tip (i.e., the tip part cover body 233) of the piston case mounting body 23. The chuck guide 25 is fastened using bolts 251 and nuts 252 (shown on the left side of the piston case mounting body 23 in FIG. 3), both of which are fastening tools; furthermore, the nuts 252 are attached from the piston case mounting body 23 side.

The tip part side of the chuck guide 25 is provided with a recessed part 253, which is disposed at the center and is circular in the paper plane view, and a required number of recessed parts 254, which are V-shaped grooves in the paper plain view and are disposed radially such that they surround the recessed part 253. The center bit 41, which comprises a head part 411 that is circular in the paper plane view, is disposed inside the recessed part 253. The peripheral bits 42*a*-42*e*, each of which includes a head part 421 that is substantially triangular in the paper plane view, are disposed in the recessed parts 254. Numerous button chips 412, which are made of cemented carbide, are provided to the head parts 411, 421 of the bits 41, 42*a*, . . . .

The chuck guide 25 is provided with mounting holes 255, which are mounts that have holes and number the same as the bits 41, 42*a*, . . . . The mounting holes 255 are positioned inside the recessed part 253 and the recessed parts 254 mentioned above. The tip parts of the drive chucks 24 mate with the base sides of the mounting holes 255. Each of the drive chucks 24 has a detent 242, which has a hexagonal nut shape; furthermore, hexagonally-shaped recessed parts 256 (refer to FIG. 2), whereto the detents 242 are mated, are formed in the mounting holes 255 of the chuck guide 25.

The base side of each of the bits 41, 42*a*, . . . is formed as a splined shaft; furthermore, each of these base sides mates with the tip part of the corresponding mounting hole 255 and thereby is mounted inside the corresponding drive chuck 24, the inner circumferential wall of which is grooved (not illustrated) for engaging therewith. The base side of each of the bits 41, 42*a*, . . . is mounted with the abovementioned bit retainer ring and O-ring such that it does not detach from the corresponding drive chuck 24.

In addition, as shown in FIG. 1, a required number of flat bars 26, which are projections, are provided to the outer circumference of the piston case mounting body 23 such that they are oriented in the axial directions thereof. In the present embodiment, multiple flat bars 26 are provided at required intervals in the circumferential directions (at a total of six locations). Furthermore, the air jetted from the tip part side of the excavating bit member 2 (i.e., the chuck guide 25) delivers to the ground surface the crushed bedrock, earth and sand (i.e., slime), and the like generated inside the excavated hole during soil foundation excavation work through gaps between the flat bars 26, 26 and the excavated hole.

Air Tank Member 3

A coupling joint 34, which is for introducing air, is provided such that it protrudes from the base end part (i.e., the upper end part in FIG. 2) of the air tank member 3. The air introduced via the coupling joint 34 is stored inside the air storage part 30, which is disposed inside the air tank member 3. A symbol 340 indicates a blow-out hole of the coupling joint 34.

As shown in FIG. 3, a coupling body 33, which is for the purpose of coupling with the base end part of the excavating bit member 2 (i.e., the insertion part 222 side of each of the piston case members 22*a*), is provided to the tip part side of the air tank member 3. Furthermore, as shown in FIG. 2, the air storage part 30 is provided internally closer to the base side (in FIG. 2, the upward side) than the coupling body 33. The air storage part 30 is compartmentalized on the coupling body 33 side by a compartment body 300, which comprises a plate shaped body that is circular in a plan view.

As shown in FIG. 3, a required number of coupling holes 331 is provided to the tip part of the coupling body 33. Furthermore, as shown in FIG. 2, one end part (in FIG. 2, the lower end part) of the air hose 351 and each of air hoses 352 is connected to the insertion part 222 of the corresponding piston case member 22*a*, . . . , which is inserted into the corresponding coupling hole 331.

The other end part (in FIG. 2, the upper end part) of each of the air hoses 351, 352 is connected to a corresponding compartment hole 3*a*, 3*b*, 3*c*, 3*d*, 3*e*, 3*f* (shown by broken lines in FIG. 7); note that the compartment holes 3*a*, 3*b*, 3*c*, 3*d*, 3*e*, 3*f* are distribution holes for working fluid that are formed in the compartment body 300. Each of the compartment holes 3*a*, . . . and each of the air hoses 351, 352 constitute working fluid piston paths for feeding the working fluid to the piston case members 22*a*, 22*b*.

Furthermore, in FIG. 2, not all of the air hoses are shown; however, the air hoses are provided corresponding to the total number of the piston case members 22*a*, 22*b* (i.e., the same number as the piston case members 22*a*, 22*b*; in the present embodiment, six). In addition, in the present embodiment, the coupling body 33 that houses the air hoses 351, 352 is, on the whole, a hollow substantially tubular body, but the coupling body 33 can also be formed as a solid shape.

In the present embodiment, each of the compartment holes 3*a*, . . . shown by the broken lines in FIG. 7 is a circular hole. The compartment holes 3*a*, . . . are provided such that they correspond to the number of piston case members 22*a*, 22*b*, . . . . Namely, as shown by the broken lines in FIG. 7, the compartment hole 3*f* (hereinbelow, sometimes called the "center compartment hole 3*f*") is provided in one location at the center part of the compartment body 300; furthermore, the compartment holes 3*a*, 3*b*, 3*c*, 3*d*, 3*e* (hereinbelow sometimes called the "peripheral compartment holes 3*a*") are provided in five locations equispaced along a circumference whose center is the center compartment hole 3*f*.

The air hose 351 (refer to FIG. 2; hereinbelow, called the "center air hose 351"), which leads out from the center piston case member 22*a* that corresponds to the center bit 41 shown in FIG. 1, is connected to the center compartment hole 3*f*. The remaining peripheral compartment holes 3*a*, . . . that surround the center compartment hole 3*f* are connected to the air hoses 352 (refer to FIG. 2; hereinbelow, called the "peripheral air hoses 352"), which lead out from the piston case members 22*b* that correspond to the peripheral bits 42*a*, . . . shown in FIG. 1. The peripheral air hoses 352 all have the same inner diameter and length.

Furthermore, a rotary body 40 (refer also to FIG. 6), which rotates by catching the air inside the air storage part 30, is provided on the air storage part 30 side in FIG. 2. The rotary body 40 is provided such that it contacts the compartment body 300. The rotary body 40 will be discussed later in detail.

Air Guide Member 8

The rotary body 40 shown in FIG. 6 is disposed inside the air guide member 8, which is a working fluid guide member that is shaped like a cup (in one embodiment like a sake cup), as shown in FIG. 2 and FIG. 5. The air guide member 8 includes: an air guide receptacle 81, which is a working fluid guide receptacle that has a semispherical shape (i.e., the shape of half a ball) and that catches the air from the blow-out hole 340 of the coupling joint 34; and a rotary body housing 82 that has a conical wall part, which is a substantially conical body, that supports the air guide receptacle 81. In the present embodiment, a base end part 823 (in FIG. 2, the lower end part) of the rotary body housing 82 is fixed to the compartment body 300 in the vicinity of the circumferential edge part of the compartment body 300, but the base end part 823 can also be directly or indirectly fixed to an inner wall surface 304 of the air storage part 30.

A required number of intake parts 821, 822, wherethrough the air is taken into the rotary body housing 82, is provided to the rotary body housing 82 shown in FIG. 5. In the present embodiment, the intake parts are the intake holes 821, which are provided on the tip part side (in FIG. 5, the upper side) of the rotary body housing 82, and the intake pipes 822, which are provided on the base side (in FIG. 5, the lower side) of the rotary body housing 82.

The intake holes 821 (refer also to FIG. 2) are provided at three locations equispaced along the circumferential surface directions of the rotary body housing 82. Each of the intake holes 821 is provided such that it is inclined in the diagonally downward direction in FIG. 2 and such that it discharges toward the rotary body 40 within. As shown in FIG. 7, the intake pipes 822 are provided slightly inclined along the rotational direction of the rotary body 40 such that the air therefrom strikes the semicircular shaped air catching blades 45 (discussed below; refer also to FIG. 6), a required number of which are provided to the rotary body 40, and thereby causes the rotary body 40 to rotate smoothly. Furthermore, the intake pipes 822 are provided such that they are inclined slightly in the diagonally downward direction toward the rotary body 40 in FIG. 2.

Based on such a configuration, the air supplied from the blow-out hole 340 of the coupling joint 34, shown in the upper part of FIG. 2, strikes the receptacle 81 of the air guide member 8, then rebounds along the recessed part surface of the receptacle 81, returns to the rotary body housing 82 side along an arcuate path, emerges via the intake holes 821 and the intake pipes 822, and is fed to the rotary body 40 side.

Rotary Body 40

As shown in FIG. 6 and FIG. 7, the rotary body 40 includes a rotary plate 43, which is circular in a plan view, and a tubular rotational shaft 4*f*, which is a shaft part that axially and rotatably supports the rotary plate 43. As shown in FIG. 2, the rotational shaft 4*f* is rotatably inserted into the center compartment hole 3*f* at the center of the compartment body 300 (refer also to FIG. 7) and has a structure such that it cannot slip out of the center compartment hole 3*f*.

As described above, the center air hose 351 is connected to the center compartment hole 3*f* (refer to FIG. 2). Thereby, the air storage part 30 and the center air hose 351 are in continuous communication via the rotational shaft 4*f*. Accordingly, the air inside the air storage part 30 is fed continuously to the center air hose 351 and drives the piston 61 inside the center piston case member 22*a*; thereby, the center bit 41 is impact driven separately from and independently of each of the peripheral bits 42*a*, . . . . A symbol 301 indicates a rolling body, such as a ball bearing.

Figure 10:
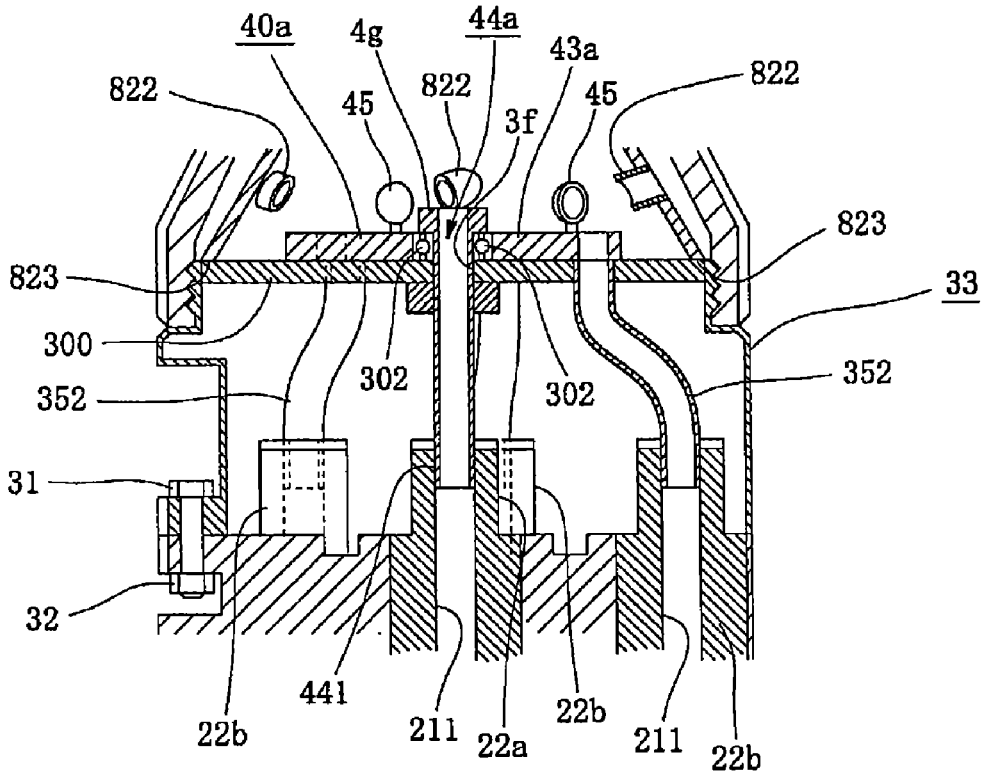
FIG. 10 is an explanatory partial enlarged view that shows another embodiment of the rotary body shown in FIG. 2.

FIG. 10 is an explanatory partial enlarged view that shows another embodiment of the rotary body shown in FIG. 2.

The rotary body 40 shown in FIG. 6 is integral with the rotational shaft 4*f* and the rotary plate 43 and rotates together therewith. In contrast, as shown in FIG. 10, a configuration can also be adopted wherein a rotary plate 43*a* rotates such that a shaft part 44*a*, which is fixed to the compartment body 300, serves as the axis. In this case, the shaft part 44*a* can be configured such that it is long, an other end part 441 thereof (the lower end part in FIG. 10) can be coupled to the center piston case member 22*a* by inserting it into the hole 211 of the center piston case member 22*a*, and the tip part of a rotational shaft 4*g* can be formed with a diameter larger than that of the compartment hole 3*f*, as in the head of a bolt. Symbols 302 indicate rolling bodies, such as ball bearings.

In addition, as shown in FIG. 7, to control the degrees of openness of the air storage part 30 (which is positioned closer to the paper surface than the rotary plate 43 is in FIG. 7) and of the peripheral compartment holes 3*a*, 3*b*, 3*c*, 3*d*, 3*e* (shown by broken lines), the rotary plate 43 has a size such that it can cover the portion of the compartment body 300 wherein the peripheral compartment holes 3*a*, . . . are provided and is provided such that it contacts the compartment body 300. The rotary plate 43 has rotational holes 4*a*, 4*b*, 4*c*, 4*d*, 4*e*, which bring the air storage part 30 into communication with each of the peripheral compartment holes 3*a*, . . . . Each of the rotational holes 4*a*, . . . constitutes a communication path wherethrough air is distributed.

As shown in FIG. 6, a required number of the rotational holes 4*a*, 4*b*, 4*c*, 4*d*, 4*e* is disposed at required intervals along a circumference (i.e., along the rotational direction of the rotary body 40) such that the rotational shaft 4*f* serves as the center. In the present embodiment, the rotational holes 4*a*, . . . are provided at five locations corresponding to the number of the peripheral piston case members 22*b*, . . . that drive the peripheral bits 42*a*, . . . . Each of the rotational holes

4*a*, . . . is a circular hole with an inner diameter that is the same or substantially the same as that of each of the peripheral compartment holes 3*a*, . . . .

Furthermore, the rotational holes 4*a*, . . . or the peripheral compartment holes 3*a*, . . . , or both, can be formed as holes that have an oblong (i.e., an elliptical) shape in a plan view and can also be formed as holes of some other shape, for example, square or rectangular. Furthermore, each of the rotational holes 4*a* can be formed with an inner diameter that is larger than that of the peripheral compartment holes 3*a*, and vice versa.

The rotational holes 4*a*, . . . are not equispaced but rather are disposed at varying intervals (i.e., with staggered spacing) along the rotational direction of the rotary body 40 such that the rotation of the rotary body 40 gradually increases the degree of openness, in sequence of the rotational holes 4*a*, . . . in the rotational direction, of the peripheral compartment holes 3*a*, . . . .

Namely, whereas the peripheral compartment holes 3*a*, . . . , which are shown by broken lines in FIG. 7, are provided at five locations equispaced along the same circumference, the rotational holes 4*a*, . . . , which are shown by solid lines, are not equispaced at five locations along this circumference but rather are provided at varying intervals, as discussed below. Accordingly, for the sake of explanatory convenience, the rotational hole 4*a*, which is not in communication with the peripheral compartment hole 3*a* in the lower right of FIG. 7, is referred to as the first rotational hole 4*a*, and the corresponding peripheral compartment hole 3*a* is referred to as the first compartment hole 3*a*.

In addition, in clockwise order in FIG. 7 (i.e., in the order of the direction opposite the rotational direction) starting from the first rotational hole 4*a*, let us refer to the subsequent rotational holes as the second rotational hole 4*b*, the third rotational hole 4*c*, the fourth rotational hole 4*d*, and the fifth rotational hole 4*e*. Similarly, in clockwise order in FIG. 7 (i.e., in the order of the direction opposite the rotational direction) starting from the first compartment hole 3*a* shown by the broken line, let us refer to the subsequent compartment holes as the second compartment hole 3*b*, the third compartment hole 3*c*, the fourth compartment hole 3*d*, and the fifth compartment hole 3*e*.

In so doing, in the state shown in FIG. 7, the second rotational hole 4*b* communicates with the second compartment hole 3*b* such that approximately ⅓ of its inner diameter overlaps the second compartment hole 3*b*; the third rotational hole 4*c* communicates with the third compartment hole 3*c* such that approximately ½ of its inner diameter overlaps the third compartment hole 3*c*; the fourth rotational hole 4*d* communicates with the fourth compartment hole 3*d* such that approximately ⅔ of its inner diameter overlaps the fourth compartment hole 3*d*; and the fifth rotational hole 4*e* communicates completely with the fifth compartment hole 3*e* such that it entirely overlaps the fifth compartment hole 3*e*. Furthermore, the rotation of the rotary body 40 causes each of the rotational holes 4*a*, . . . to communicate with each of the peripheral compartment holes 3*a*, . . . and the air is fed through the peripheral air hoses 352 to the peripheral piston case members 22*b*, where it drives the peripheral bits 42*a*, . . . shown in FIG. 1. The detailed operation of the rotary body 40 will be discussed later.

As shown in FIG. 6 and FIG. 7, the semicircular shaped air catching blades 45 are provided (at a total of five locations) in the vicinity of substantially the middle position between each adjacent pair of rotational holes 4*a*,4*b*, . . . . The air catching blades 45 are disposed along the circumferential edge part of the rotary plate 43. The air catching blades 45 are fixed to the rotary plate 43 of the rotary body 40 via rod shaped support parts 451 (refer to FIG. 6). The air catching blades 45 are attached such that their recessed part surfaces face opposite the rotational direction and such that the rotary body 40 rotates in the left-handed rotational direction (i.e., counterclockwise) in FIG. 6. Furthermore, the present invention is not limited to the number of air catching blades 45 illustrated.

Furthermore, as illustrated in FIG. 7, a required number of the air supply holes 46, which are working fluid supply holes that pass through the rotary plate 43 and whose inner diameters are smaller than those of the rotational holes 4*a*, is provided between adjacent pairs of air catching blades 45 and rotational holes 4*a*, . . . (in the present embodiment, at one location per pair with a total of 10 locations over the entire rotary plate 43). The air supply holes 46 are provided along a circumference such that the rotational shaft 4*g* serves as the center and such that they communicate with the peripheral compartment holes 3*a*, 3*b*, 3*c*, 3*d*, 3*e*. The rotation of the rotary body 40 brings each of the air supply holes 46 into communication with one of the peripheral compartment holes 3*a*, . . . , and thereby the air from the air storage part 30 is fed a little bit at a time to each of the peripheral piston case members 22*b* and drives the piston 61 therein as far as the standby state prior to a strike. The operation will be discussed later.

Outer Circumferential Portion of the Air Tank Member 3

As shown in FIG. 2, the air tank member 3 on the base side (i.e., the upper part side in FIG. 2) of the coupling body 33 bounds the coupling body 33 and is formed such that it narrows slightly toward its base side. The outer diameter of a small caliber portion 36, which is formed with a diameter slightly smaller than that of the coupling body 33, matches the inner diameter of a tubular drive bushing 51, which is provided to the rotary drive apparatus 5 (discussed below; refer to FIG. 9). Furthermore, as shown in FIG. 9, the excavating apparatus 1, in the erect state, is dropped down such that the drive bushing 51 mates with the base end part of the excavating apparatus 1, whereupon the drive bushing 51 stops the excavating apparatus 1 at the portion at which the diameter of the air tank member 3 is large (in the vicinity of the coupling body 33), and the excavating apparatus 1 does not drop downward any further. The details of this operation are discussed later.

Furthermore, as shown in FIG. 1, a required number of flat bars 361, which are projections, are provided to the outer circumference of the air tank member 3 such that they are oriented in the axial directions thereof. In the present embodiment, a plurality of flat bars 361 is provided (at a total of six locations). Furthermore, when excavation work is performed, these flat bars 361 engage with mating grooves provided to an inner wall part of the drive bushing 51 of the rotary drive apparatus 5 (refer to FIG. 9), which comprises a rotary table that is discussed below, and transmit the rotary drive force (i.e., the rotary motion) of the drive bushing 51 to the excavating apparatus 1.

Rotary Drive Apparatus 5

Moreover, as described above, the rotary drive apparatus 5 shown in FIG. 9 imparts rotary motion to the excavating apparatus 1. The rotary drive apparatus 5 comprises a rotary drive apparatus main body 50 and outriggers 52, which support the rotary drive apparatus main body 50. As described above, the rotary drive apparatus main body 50 comprises a rotary table (not shown in FIG. 9 because it is hidden), whereto the excavating apparatus 1 can be mounted via the drive bushing 51 and that can impart rotary motion to the excavating apparatus 1.

Operation

The operation of the rotary excavator 6, which comprises the excavating apparatus 1, will now be explained. Furthermore, the present embodiment explains the operation of the rotary excavator 6 taking as an example a case wherein a pile hole is excavated in the soil foundation.

First, as shown in FIG. 9, the rotary drive apparatus 5, which is a constituent element of the rotary excavator 6, is mounted on temporary footholds 600, which are erected using, for example, H-beams. Moreover, a required number (i.e., a necessary number) of kelly rods 7, in accordance with the length of the hole to be excavated in the soil foundation, are connected to the base end part of the excavating apparatus 1. In the present embodiment, one kelly rod 7 may be connected, or two or more (i.e., a plurality) may be connected.

The kelly rod 7 has a built-in air supply pipe. The kelly rod 7 and the excavating apparatus 1 are fastened together by fastening tools (not illustrated), which comprise pins, bolts, nuts, and the like. The excavating apparatus 1, to which the kelly rod 7 is connected, is supported by the crane (not shown in the drawings) such that it is suspended therefrom. In FIG. 9, a symbol 73 indicates a wire that is connected to the crane.

Furthermore, the drive bushing 51 is set on the rotary table (hidden in FIG. 5 and therefore not shown) of the rotary drive apparatus 5. Furthermore, while the excavating apparatus 1 is suspended from and supported by the crane, the flat bars 361 of the air tank 30 member 3 of the excavating apparatus 1 are engaged with mating grooves (hidden in the drawings and therefore not shown), which are grooves in the inner wall of the drive bushing 51. Furthermore, excavation is started while the excavating apparatus 1 is suspended from the crane.

During excavation, the rotary drive force transmitted from the rotary table to the drive bushing 51 is further transmitted to the air tank member 3, and thereby the excavating apparatus 1 rotates. A support shaft 71, which is for suspending the kelly rod 7 from the crane, is provided to the upper end of the kelly rod 7. A supply pipe 72, which supplies air to the excavating apparatus 1, is connected to the support shaft 71. In addition, an air swivel (not illustrated) is provided to the support shaft 71.

The air fed from the supply pipe 72 is fed to the excavating apparatus 1 via the air supply pipe of the kelly rod 7. The air fed to the excavating apparatus 1 is discharged from the blow-out hole 340 of the coupling joint 34, which is shown in FIG. 2, and stored in the air storage part 30.

The air supplied from the blow-out hole 340 strikes the receptacle 81 of the air guide member 8, then rebounds along the recessed part surface of the receptacle 81, returns to the rotary body housing 82 side along an arcuate path, and is fed to the rotary body 40 side.

Figure 8:
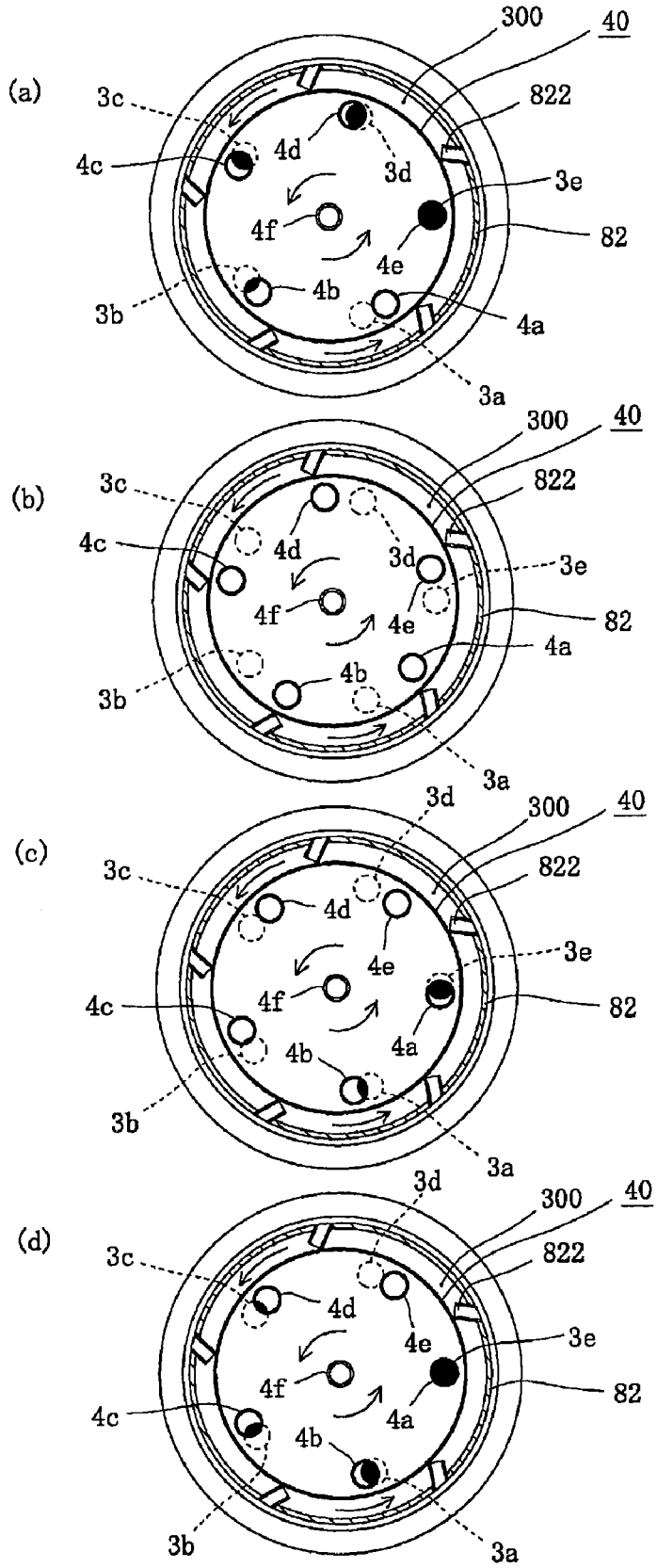
FIG. 8 includes explanatory partial schematic views that show rotating states of the rotary body shown in FIG. 7 over the course of time.

Furthermore, while the air catching blades 45 catch the air, the rotary body 40 rotates in the left-handed rotational direction (i.e., counterclockwise) starting from the state shown in FIG. 8(*a*) and proceeding, in order, through the states shown in FIGS. 8(*b*), (*c*), and (*d*). Furthermore, FIGS. 8(*a*)-(*d*) show the rotating states of the rotary body 40 over the course of time; however, for the sake of explanatory convenience, the time intervals between the drawings are not all the same.

The air rotates the rotary body 40, additionally passes through the air hoses 351, 352 via both the tubular rotational shaft 4*f* (4*g*) and the rotational holes 4*a*-4*e* of the rotary body 40 shown in FIG. 2 (FIG. 10), is fed to the corresponding piston case members 22*a*, 22*b*, and impact drives the center bit 41 and the peripheral bits 42*a*, . . . .

Among the bits, the center bit 41 is not controlled by the amount of air flow from the rotary body 40, and therefore the air that is continuously fed from the rotational shaft 4*f* (4*g*) to the center piston case member 22*a* impact drives the center bit 41 independently of the strike operation of the other peripheral bits 42*a*.

In contrast, the rotation of the rotary body 40 controls the degrees of openness of the air storage part 30 and the peripheral compartment holes 3*a*, and thereby the peripheral bits 42*a*, . . . are impact driven as described below.

Namely, in the state shown in FIG. 8(*b*), the fifth rotational hole 4*e* that was in communication with the fifth compartment hole 3*e* in FIG. 8(*a*) moves and transitions to the noncommunicative state; the other rotational holes 4*a*, 4*b*, 4*c*, 4*d* transition to states of noncommunication with the other peripheral compartment holes 3*a*, 3*b*, 3*c*, 3*d*.

In addition, in the state shown in FIG. 8(*c*), which is achieved by further rotation, the first rotational hole 4*a* that was in the noncommunicative state as shown in FIG. 8(*b*) now communicates with the fifth compartment hole 3*e* such that approximately ⅔ of its inner diameter overlaps the fifth compartment hole 3*e*, the second rotational hole 4*b* communicates with the first compartment hole 3*a* such that approximately ⅓ of its inner diameter overlaps the first compartment hole 3*a*, and the third rotational hole 4*c* is still in the noncommunicative state. The communication states of the fourth rotational hole 4*d* and the fifth rotational hole 4*e* as illustrated in FIG. 8(*c*) are both in the noncommunicative state.

Furthermore, in the state shown in FIG. 8(*d*), the first rotational hole 4*a* that was in approximately ⅔ communication in the state shown in FIG. 8(*c*) is now in complete communication with the fifth compartment hole 3*e*, the second rotational hole 4*b* that was in approximately ⅓ communication now communicates with the first compartment hole 3*a* such that approximately ½ of its inner diameter overlaps the first compartment hole 3*a*, and the third rotational hole 4*c* that was in the noncommunicative state now communicates with the second compartment hole 3*b* such that approximately ⅓ of its inner diameter overlaps the second compartment hole 3*b*. The communication states of the fourth rotational hole 4*d* and the fifth rotational hole 4*e* are in minor communication with the third compartment hole 3*c* and in the noncommunicative state with the fourth compartment hole 3*d*, respectively.

As described above, the rotation of the rotary body 40 gradually increases—in the rotational direction—the degrees of openness of each of the first rotational holes 4*a*, . . . to the corresponding compartment holes 3*a*, . . . ; furthermore, after each of the first rotational holes 4*a*, . . . has been brought, in order, into communication, each returns once again to the noncommunicative state shown in FIG. 8(*b*), and the cycle is then performed repetitively.

Thus, by bringing, in order, each of the rotational holes 4*a*, . . . into communication in the rotational direction of the rotary body 40, the air is not introduced from the air storage part 30 to the peripheral piston case members 22*b* simultaneously, but rather is introduced sequentially and staggered in time. Thereby, the peripheral bits 42*a*, . . . (refer to FIG. 1) corresponding to the peripheral piston case members 22*b* strike, in turn, in the order of the peripheral bits 42*a*, 42*b*, 42*c*, 42*d*, 42*e* in the circumferential directions. Accordingly, the impact forces produced by the strikes of the bits 41, 42*a*, . . . are imparted to the excavation surface substantially evenly, without missing a spot.

In addition, as described above, the rotation of the rotary body 40 brings the air supply holes 46, the inner diameters of which are smaller than that of the rotational hole 4*a*, into communication with the peripheral compartment holes 3*a*, . . . , and thereby the air from the air storage part 30 is fed a little bit at a time to each of the peripheral piston case members 22*b*. Thereby, the working fluid is fed until the piston 61 inside each of the peripheral piston case members 22*b* reaches the standby state prior to strike (i.e., the state wherein the piston 61 has moved upward or the state wherein the air is fed to the peripheral piston case members 22*b* to some degree even though the corresponding piston 61 does not rise). As a result, when each of the rotational holes 4*a* coincides with the corresponding peripheral compartment hole 3*a*, the corresponding piston 61 promptly falls and the bit 41 strikes. Namely, the time shift between the coincidence of one of the rotational holes 4*a* with one of the peripheral compartment holes 3*a* and the striking of the bit 41 is eliminated or shortened.

Thus, by performing the impact drive while the bits 42*a*, . . . are operated staggered in time, the excavation work can be performed at lower noise and vibration levels than those of the conventional down-the-hole hammer, wherein the earth surface is struck by moving up and down one hammer bit with a diameter substantially the same as the hole to be excavated. Accordingly, the present invention is suited to use in, for example, dense residential areas and urban business districts.

Furthermore, the rotary motion imparted to the excavating apparatus 1 by the rotary drive apparatus 5 moves, with respect to the excavation surface, the excavation position of each of the peripheral bits 42*a*, . . . of the excavating apparatus 1. Thereby, the bits 41, 42 strike the entire excavation surface without missing any spots. In addition, rotating the excavating apparatus 1 smoothly delivers the crushed bedrock, earth and sand (i.e., slime), and the like produced during excavation to the ground surface.

In addition, as shown in FIG. 2, the driving means, such as the pistons 61 that operate the bits 41, 42*a*, . . . , are housed inside the piston case main bodies 220, are furthermore covered by the tubular piston case casings 232, and are furthermore housed inside the tubular main body 231 that is filled with the sand 230, which is a vibration isolating and/or sound insulating material. Thereby, it is possible to prevent the sound and vibration generated during the drive of the driving means from leaking externally or being transmitted, and therefore to reduce the sound and vibration levels.

In addition, in the present embodiment, the rotary drive apparatus 5 comprises the outriggers 52, which not only improve stability during excavation work, but also dampen vibration transmitted from the rotary drive apparatus main body 50 to the grounding surface to a greater extent than the case wherein excavation is performed with the rotary drive apparatus main body 50 mounted directly on the grounding surface. Thereby, the present invention effectively reduces vibration and noise levels.

Furthermore, as described above, the conventional art necessitates driving a hammer bit with a large diameter substantially the same as that of the hole to be excavated; consequently, driving the hammer bit up and down inevitably consumes a large amount of air, and therefore a comparatively large air compressor is required.

In contrast, in the present embodiment, each of the small-diameter bits 41, 42*a*, . . . is driven, in turn, into the hole to be excavated; accordingly, because a small amount of air is consumed in moving a single bit up and down, the air compressor used can be made more compact. Accordingly, the air compressor needs only a small amount of installation surface area, and the present invention is suited to construction work in locations where space is limited, such as dense residential areas and urban business districts. In addition, making the air compressor more compact makes it possible to reduce the size of the prime mover that drives the air compressor, which in turn makes it possible to reduce the levels of vibration and noise generated by the prime mover.

Furthermore, in the present embodiment, the excavating bit member 2 that is provided with the bits 41, 42*a*, . . . at a total of six locations is used, but the present invention is not particularly limited to that number. In the present embodiment, the diameter of the excavating bit member 2 is, for example, 450-700 mm.

Unlike the present embodiment, if the excavating bit member 2 were configured with bits at, for example, five locations (i.e., in one location at the shaft center part and in four locations therearound), then the diameter of the excavating bit member 2 could be, for example, less than 450 mm. Furthermore, if the excavating bit member 2 were configured with bits at, for example, six to seven locations (i.e., in one location at the shaft center part and in five locations or six locations therearound), then the diameter of the excavating bit member 2 could be, for example, 700 mm or greater.

Furthermore, a screw shaft that comprises an air supply pipe can be used instead of the kelly rod 7. If a screw shaft were used, then the crushed bedrock, earth and sand (i.e., slime), and the like generated during excavation could be delivered (i.e., removed) to the ground surface more smoothly. In addition, helical blades for earth removal can also be provided to a circumferential surface part of the air tank member 3.

In addition, the present embodiment explained the case wherein excavation work is performed using the rotary drive apparatus 5 that comprises the rotary table, but the means for imparting rotary motion to the excavating apparatus 1 is not limited to the rotary table; for example, it is also possible to employ a well known rotary driving means, such as a three point pile driver or a leader.

Figure 11:
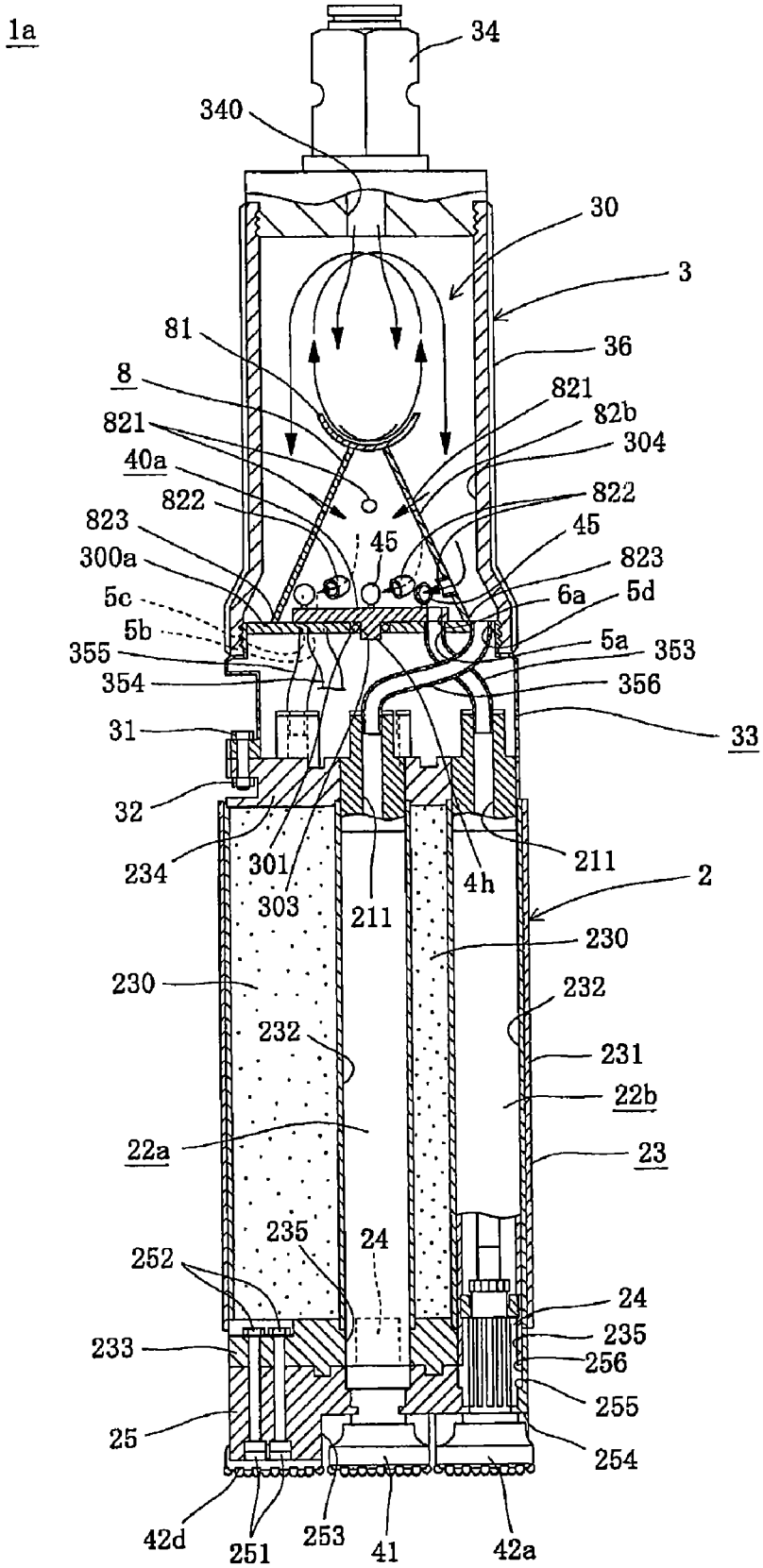
FIG. 11 is an explanatory longitudinal cross sectional view of the excavating apparatus according to another embodiment.
Figure 12:
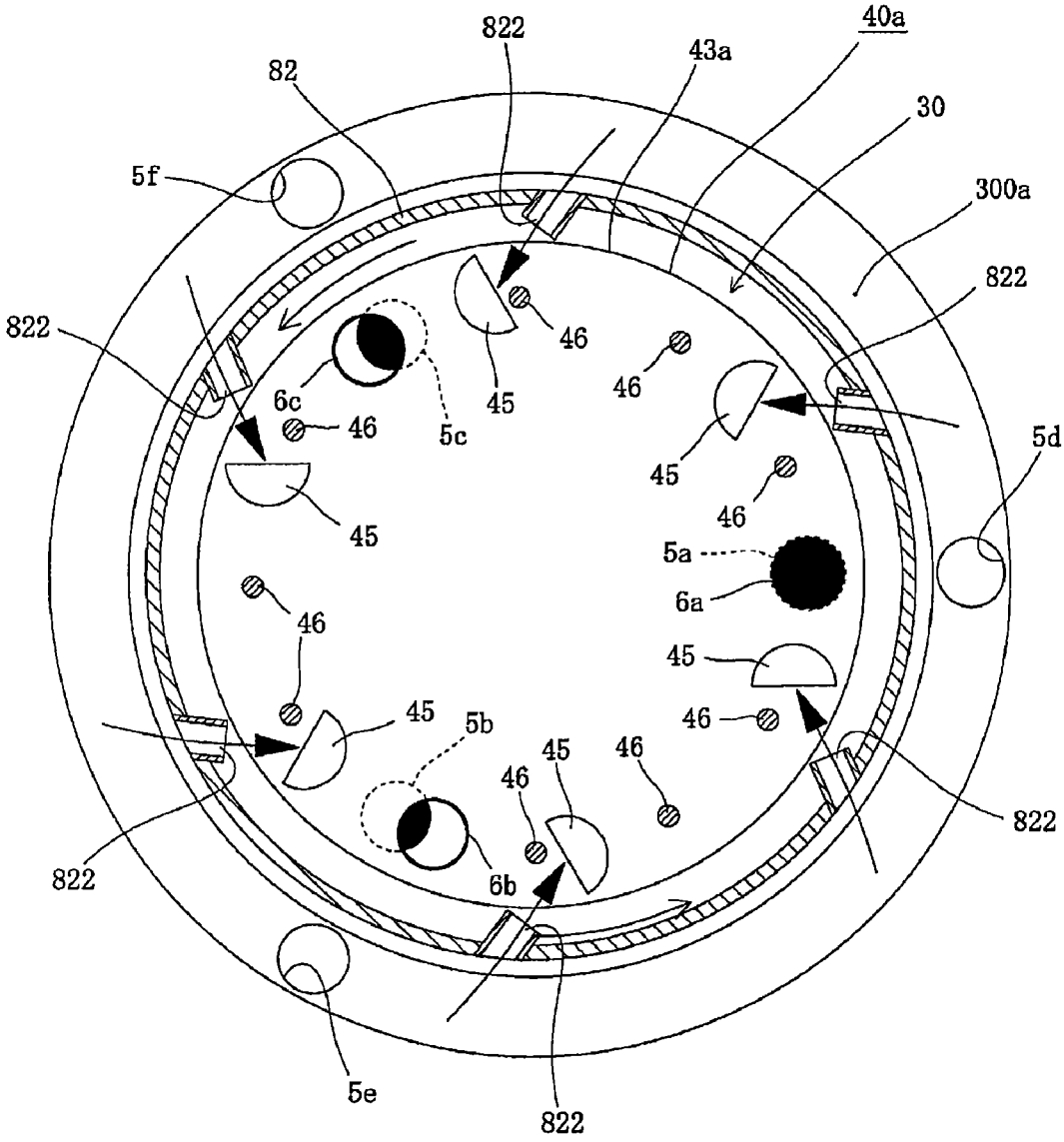
FIG. 12 is an explanatory plan view that shows the internal structure, including the rotary body, of an air guide member shown in FIG. 11, wherein the cross section is taken along the horizontal directions.

FIG. 11 and FIG. 12 are views for explaining another embodiment of the excavating apparatus for underground excavation according to the present invention.

FIG. 11 is an explanatory longitudinal cross sectional view of the excavating apparatus according to this embodiment, and FIG. 12 is an explanatory plan view that shows the internal structure of the air guide member, including the rotary body, shown in FIG. 11, with the cross section taken in the horizontal directions; furthermore, FIG. 11 is a view that corresponds to FIG. 7 mentioned above.

Furthermore, in the present embodiment, the same symbols are assigned at the same or equivalent locations as those in the above embodiment. In addition, the following text omits explanations of locations explained in the above embodiment and principally explains the points of difference.

In the previous embodiment described above (refer to FIG. 2 and FIG. 7), the rotary body 40 controls the degrees of openness of the five peripheral compartment holes 3*a*, 3*b*, 3*c*, 3*d*, 3*e*. In contrast, with an excavating apparatus 1*a* according to the present embodiment, a rotary body 40*a* shown in FIG. 12 controls the degrees of openness of three compartment holes 5*a*, 5*b*, 5*c* (hereinbelow, called the "inward compartment holes 5*a*, 5*b*, 5*c*"). Furthermore, three compartment holes 5*d*, 5*e*, 5*f* (hereinbelow, called the "outward compartment holes 5*d*, 5*e*, 5*f*") are disposed on the outer side of the rotary body 40*a*.

The excavating apparatus 1*a* according to the present embodiment will now be explained in greater detail.

Unlike in the above embodiment (refer to FIG. 2), a rotational shaft 4*h* of the rotary body 40*a* shown in FIG. 11 is not formed tubularly and air hoses are not connected thereto. Rather, the rotational shaft 4*h* is provided such that it is rotatably inserted into and will not slip off of a bearing hole 303, which is formed in the center of a compartment body 300*a*. The abovementioned inward compartment holes 5*a*, 5*b*, 5*c* (indicated by the broken lines) are disposed at three locations equispaced along the circumference of the compartment body 300*a* (refer to FIG. 12), such that the bearing hole 303 serves as the center.

Among the compartment holes, the singular inward compartment hole 5*a* (positioned on the right side in FIG. 12) is connected to a peripheral air hose 353, which leads out from the peripheral piston case member 22*b* (refer to FIG. 11) that corresponds to the peripheral bit 42*a* shown in FIG. 1. In addition, of the remaining compartment holes, the inward compartment hole 5*b* (positioned to the lower right of the compartment hole 5*a* in FIG. 12) is connected to a peripheral air hose 354 (partly not shown; refer to FIG. 11), which leads out from the peripheral piston case member 22*b* that corresponds to the peripheral bit 42*c* shown in FIG. 1. Furthermore, the other remaining inward compartment hole, that is, the inward compartment hole 5*c* (positioned to the upper left of the compartment hole 5*a* in FIG. 12) is connected to a peripheral air hose 355 (refer to FIG. 11), which leads out from the peripheral piston case member 22*b* that corresponds to the peripheral bit 42*d* shown in FIG. 1. Furthermore, the inner diameters and the lengths of the air hoses 353, 354, 355 to which these inward compartment holes 5*a*, 5*b*, 5*c* are connected are all the same.

The rotary plate 43*a* has rotational holes 6*a*, 6*b*, 6*c*, which bring the air storage part 30 and the inward compartment holes 5*a*, 5*b*, 5*c* into communication. Each of the inward rotational holes 6*a*, . . . comprises a communication path wherethrough air is distributed. A required number of the rotational holes 6*a*, 6*b*, 6*c* is disposed at required intervals along the circumference of the rotary plate 43*a* (i.e., in the rotational direction of the rotary body 40*a*) such that the center of rotation of the rotary plate 43*a* serves as the center. In the present embodiment, the rotational holes 6*a*, 6*b*, 6*c* are provided at a total of three locations, corresponding in number to the abovementioned inward compartment holes 5*a*, 5*b*, 5*c*. In addition, in the present embodiment, each of the rotational holes 6*a*, 6*b*, 6*c* is a circular hole whose inner diameter is substantially the same as that of the inward compartment holes 5*a*, 5*b*, 5*c*.

As described above, the inward compartment holes 5*a*, 5*b*, 5*c* (indicated by the broken lines) are provided equispaced. In contrast, the rotational holes 6*a*, . . . are not equispaced but rather are disposed at varying intervals (i.e., with staggered spacing) along the rotational direction of the rotary body 40*a* such that the rotation of the rotary body 40*a* gradually increases the degree of openness, in sequence of the rotational holes 6*a*, . . . in the rotational direction, of the compartment holes 5*a*, 5*b*, 5*c*.

For the sake of explanatory convenience, the rotational hole 6*a*, the full circle of which is in complete communication with the inward compartment hole 5*a* (positioned on the right side in FIG. 12), shall be called the first rotational hole 6*a*. Furthermore, in clockwise order (i.e., in the direction opposite the rotational direction) in FIG. 12 and starting from the first rotational hole 6*a*, the other rotational holes shall be called the second rotational hole 6*b* and the third rotational hole 6*c*. In addition, similarly, in the clockwise order (i.e., in the direction opposite the rotational direction) in FIG. 12 and starting from the inward compartment hole 5*a* on the right side, the other compartment holes shall be called the second inward compartment hole 5*b* and the third inward compartment hole 5*c*.

In the present embodiment, in the state shown in FIG. 12, the second rotational hole 6*b* communicates with the second inward compartment hole 5*b* such that approximately ⅓ of its inner diameter overlaps the second inward compartment hole 5*b*; furthermore, the third rotational hole 6*c* communicates with the third inward compartment hole 5*c* such that approximately ½ of its inner diameter overlaps the third inward compartment hole 5*c*. The communicating states between the rotational holes 6*a*, . . . and the inward compartment holes 5*a*, . . . created by the rotation of the rotary body 40*a* will be discussed later, along with the operation thereof.

As shown in FIG. 12, a required number of the air catching blades 45 (at two locations between adjacent pairs of rotational holes 6*a*, . . . , with a total of six locations) are provided with required spacings between adjacent pairs of rotational holes 6*a*, . . . . Furthermore, air supply holes 46, whose inner diameters are smaller than those of the rotational holes 6*a*, are provided at required positions between pairs of rotational holes 6*a* and air catching blades 45 such that the air supply holes 46 avoid the rotational holes 6*a* and the air catching blades 45. The operation of the air catching blades 45 and the air supply holes 46 is the same as that in the previous embodiment, and therefore the explanation thereof is omitted.

As shown in FIG. 11, the base end part 823 (i.e., the lower end part in FIG. 11) of the rotary body housing 82 is fixed slightly inside the circumferential edge part of the compartment body 300*a*. Furthermore, a required number of the outward compartment holes 5*d*, 5*e*, 5*f* (in the present embodiment, at three locations equispaced to create the vertices of an equilateral triangle), which are distribution holes wherethrough the working fluid is distributed, are provided at required intervals in the portion of the compartment body 300*a* (refer also to FIG. 12) positioned between the base end part 823 and the inner wall surface 304 of the air storage part 30.

Among the compartment holes, the singular outward compartment hole 5*d* (positioned on the right side in FIG. 12) is connected to a center air hose 356, which leads out from the center piston case member 22*a* (refer to FIG. 11) that corresponds to the center bit 41 shown in FIG. 1. In addition, of the remaining compartment holes, the outward compartment hole 5*e* (positioned to the lower right in FIG. 12) is connected to a peripheral air hose (partly not shown), which leads out from the peripheral piston case member 22*b* that corresponds to the peripheral bit 42*b* shown in FIG. 1. Furthermore, the other remaining outward compartment hole, that is, the outward compartment hole 5*f* (positioned to the upper left in FIG. 12), is connected to a peripheral air hose (not shown), which leads out from the peripheral piston case member 22*b* that corresponds to the peripheral bit 42*e* shown in FIG. 1. Furthermore, the diameters and the lengths of the air hoses to which these outward compartment holes 5*d*, 5*e*, 5*f* are connected are all the same.

Operation

The excavating apparatus 1*a* according to the present embodiment operates as described below. Furthermore, explanations of portions of the operation that are in principle the same as those described in the above embodiment will be omitted.

As in the above embodiment, the air supplied from the blow-out hole 340 of the coupling joint 34 shown in FIG. 11 strikes the air guide member 8, is fed to the tip part side of the air storage part 30, and is partly fed to the rotary body 40*a* inside the rotary body housing 82.

The air fed to the tip part side of the air storage part 30 is then fed to the outward compartment holes 5*d*, 5*e*, 5*f* positioned on the outer side of the rotary body housing 82 in FIG. 12. Furthermore, air is continuously fed from the outward compartment holes 5*d*, 5*e*, 5*f* to the corresponding piston case members 22*a*, 22*b*, 22*b* without being controlled by the distribution of the air by the rotary body 40*a*, and thereby the center bit 41, the peripheral bit 42*b*, and the peripheral bit 42*e* shown in FIG. 1 are impact driven simultaneously.

Moreover, the air fed to the interior of the rotary body housing 82 rotates the rotary body 40*a* shown in FIG. 12 in the left-handed rotation direction (i.e., counterclockwise). Furthermore, the rotation of the rotary body 40*a* controls the degrees of openness between the air storage part 30 and the inward compartment holes 5*a*, 5*b*, 5*c*. Namely, by making the rotational holes 6*a*, 6*b*, 6*c*, which are indicated by the solid lines in FIG. 12, coincide with the inward compartment holes 5*a*, 5*b*, 5*c*, which are indicated by the broken lines, the air storage part 30 and the inward compartment holes 5*a*, 5*b*, 5*c* communicate, and thereby the peripheral bits 42*a*, . . . shown in FIG. 1 are impact driven in order and staggered in time.

In detail, as in the rotary body 40 explained in the above embodiment, the inward compartment holes 5*a*, 5*b*, 5*c* are not equispaced but rather are disposed at varying intervals (i.e., with staggered spacing). Furthermore, the rotation of the rotary body 40*a* gradually increases the degrees of openness—in the rotational direction—between the first rotational holes 6*a*, . . . and the inward compartment holes 5*a*, 5*b*, 5*c*, and thereby the air is not introduced from the air storage part 30 to the peripheral piston case members 22*b* simultaneously but rather is introduced sequentially and staggered in time. Thereby, the peripheral bits 42*a*, 42*c*, 42*d* shown in FIG. 1 strike, in that order, staggered in time.

To reiterate the drive states of the bits 41, 42*a*, . . . explained above referencing FIG. 1, the three bits, that is, the center bit 41 and the peripheral bits 42*b*, 42*e*, are simultaneously impact driven, and the remaining three bits, that is, the peripheral bits 42*a*, 42*c*, 42*d*, are impact driven, in that order, staggered in time.

Thus, unlike the previous embodiment (which is configured such that all of the peripheral bits 42*b*, . . . are impact driven in order and staggered in time), the present embodiment (i.e., the second embodiment) comprises both the peripheral bits 42*a*, 42*c*, 42*d*, which are impact driven in order and staggered in time, as well as the center bit 41 and the peripheral bits 42*b*, 42*e*, which are impact driven simultaneously.

Accordingly, in the present embodiment, the center bit 41 and the peripheral bits 42*b*, 42*e*, which are impact driven simultaneously, impart simultaneously a large impact force to the earth surface, yielding a high excavation working efficiency. In other words, although the previous embodiment is superior to the present embodiment with regard to reduction of the vibration and noise levels, the present embodiment is superior with regard to excavation working efficiency.

Accordingly, in locations where the generation of some vibration and noise is not a problem (e.g., locations somewhat distant from any dense residential area or urban business district), the use of the excavating apparatus 1*a* of the present embodiment is the superior choice for increasing excavation working efficiency and decreasing the number of construction work days.

In addition, even if excavation work were performed at the same site as construction work, the effect of vibration and noise on the area surrounding the site would diminish as the depth of the hole in the earth increased. Accordingly, as a first step, the excavating apparatus 1 (refer to FIG. 2) of the previous embodiment is used to dig into the ground surface up to a required depth; next, as a second step, the excavation apparatus 1 is replaced with the excavating apparatus 1*a* (refer to FIG. 11) of the present embodiment, which continues the excavation work; as a result, excavation working efficiency can be improved and the number of construction work days can be reduced while minimizing the impact of vibration and noise on the areas surrounding the site.

Furthermore, with respect to the reduction of vibration and noise levels, the present embodiment is certainly superior to the conventional down-the-hole hammer, wherein a single hammer bit with a diameter substantially the same as that of the hole to be excavated is impact driven.

In addition, in the present embodiment, three of the plurality of bits 41, 42*a*, . . . shown in FIG. 1, namely, the center bit 41 and the peripheral bits 42*b*, 42*e*, can be impact driven simultaneously, but the present invention is not particularly limited to the number and positions of the simultaneously driven bits.

Figure 13:
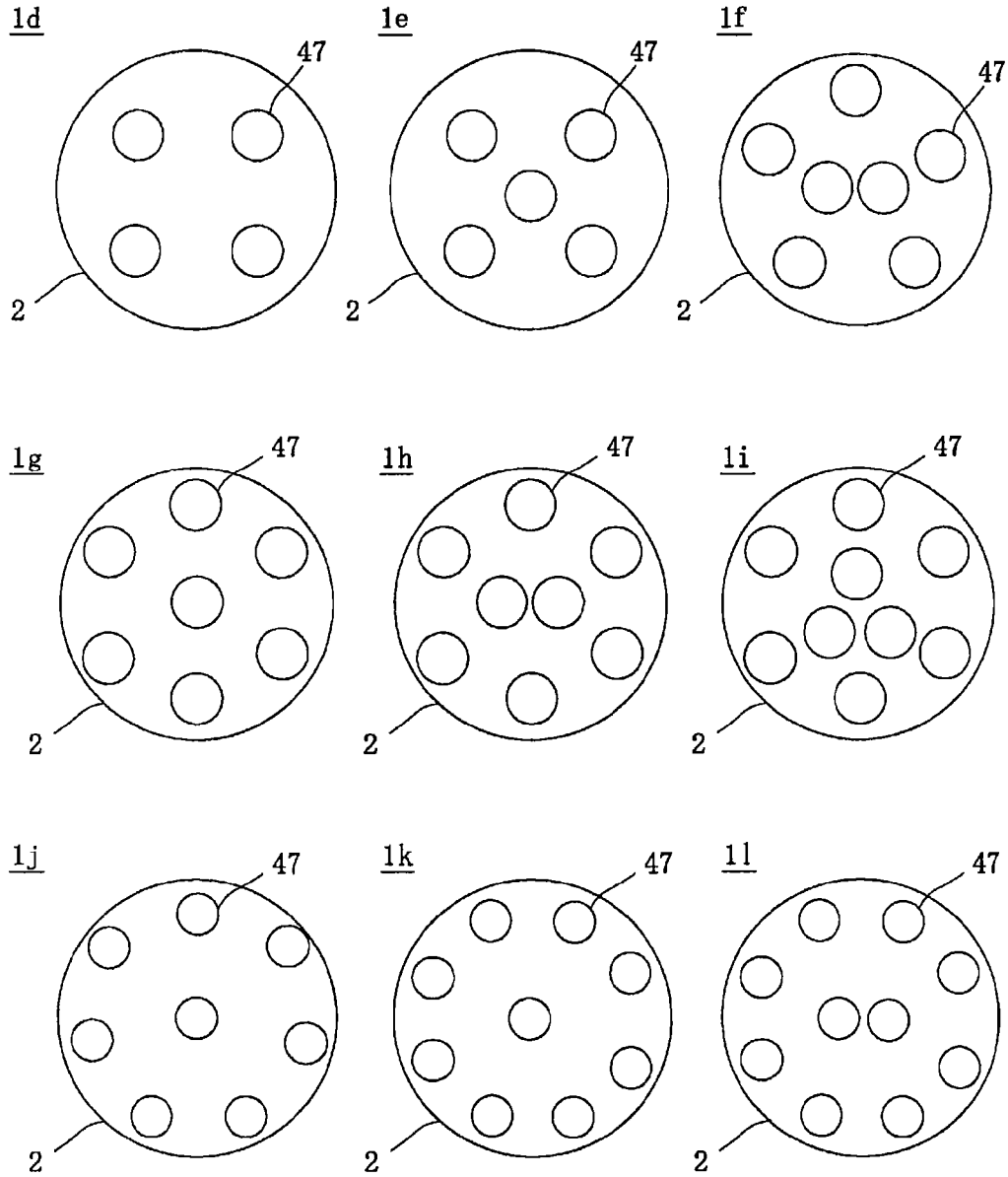
FIG. 13 is an explanatory schematic view that shows variations of the excavating apparatus manufactured such that the number and positions of the bits vary.

Furthermore, FIG. 13 shows variations in the excavation apparatuses manufactured with different numbers of bits at different positions and schematically shows the states of the excavating apparatuses, viewed from the bit tips. In FIG. 13, bits 47 are indicated by the small circles and the excavating bit member 2 is indicated by the large circles.

The present invention is not particularly limited with respect to the total number and the positions of the bits; for example, each of the variations shown in FIG. 13, namely, excavating apparatuses 1*d*-1*l*, is conceivable. Namely, as shown in FIG. 13, bits can be provided at, for example, four to ten locations; furthermore, bits can be provided at three locations or at eleven or more locations. In addition, the center bits 47 may be omitted, and it is also possible to provide a bit at one location in the center, as well as to provide bits at two, three, or more locations at the center.

Figure 14:
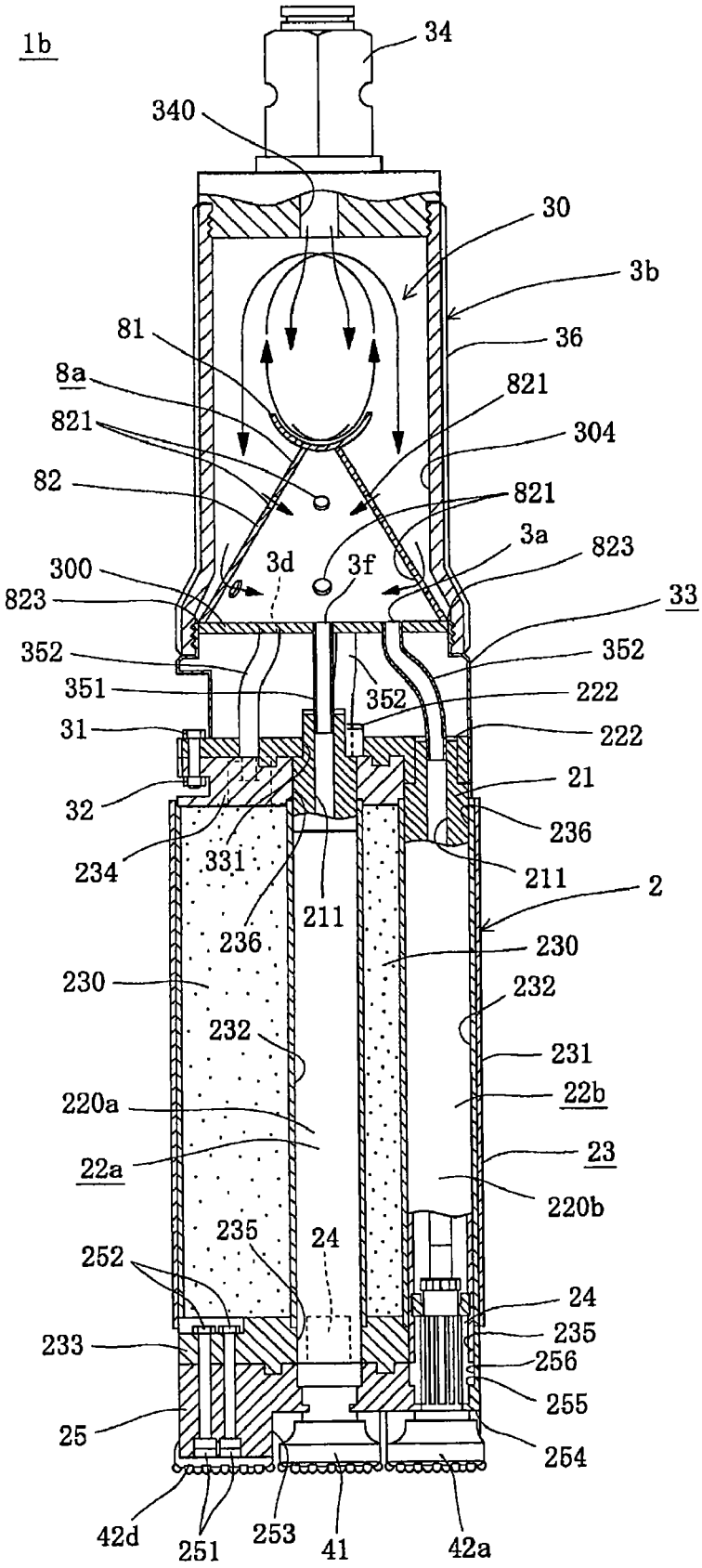
FIG. 14 is an explanatory longitudinal cross sectional view of the excavating apparatus according to a further embodiment.
Figure 15:
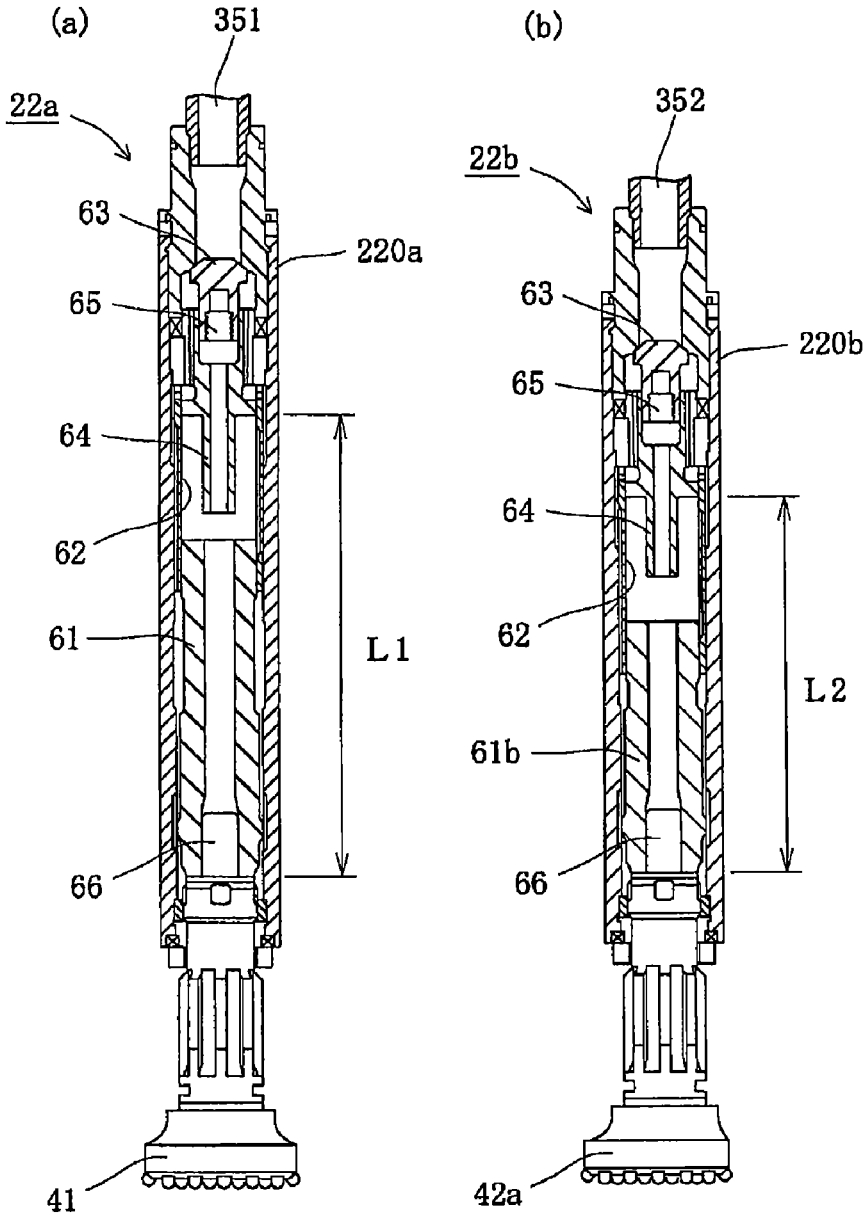
FIG. 15(*a*) is the same explanatory longitudinal cross sectional view as the one shown in FIG. 4(*a*), and FIG. 15(*b*) is an explanatory longitudinal cross sectional view of another piston case member that is housed in the excavating bit member.
Figure 16:
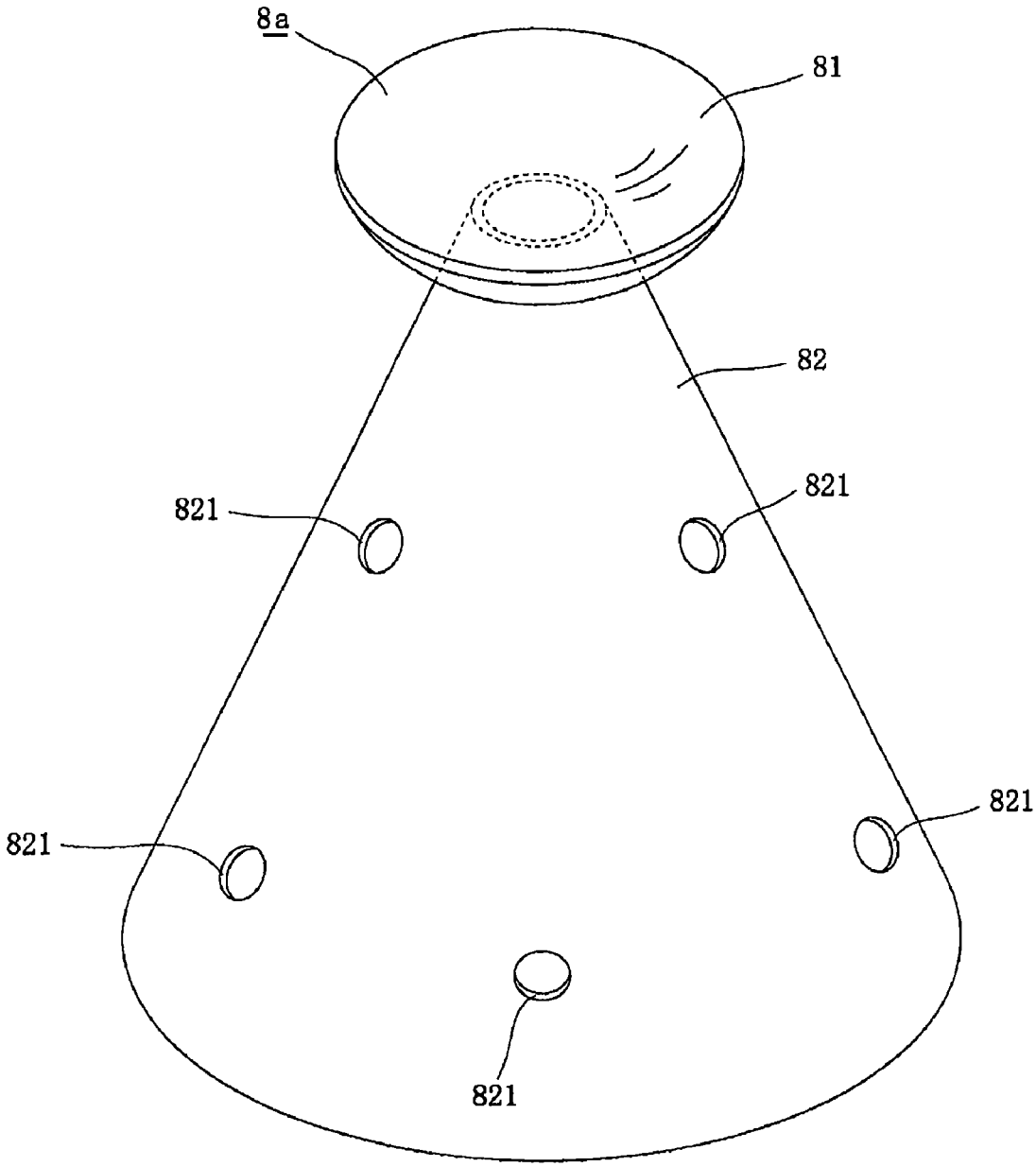
FIG. 16 is an explanatory oblique view that shows the fluid guide member, which is disposed inside the air tank member of the excavating apparatus shown in FIG. 14.

FIG. 14 through FIG. 16 are views for explaining the embodiment of the excavating apparatus for underground excavation according to the present invention. FIG. 14 is an explanatory longitudinal cross sectional view of the excavating apparatus according to this embodiment; FIG. 15 includes FIG. 15(*a*), which is the same explanatory longitudinal cross sectional view as that shown in FIG. 4(*a*), and FIG. 15(*b*), which is an explanatory longitudinal cross sectional view of another piston case member housed in the excavating bit member; and FIG. 16 is an explanatory oblique view that shows the fluid guide member, which is disposed inside the air tank member of the excavating apparatus shown in FIG. 14. An excavating apparatus 1*b* will now be explained. Furthermore, the same symbols are assigned at the same or equivalent locations as those in the previous embodiments. In addition, the following text omits explanations of locations explained in the previous embodiments and principally explains the points of difference.

Excavating Apparatus 1*b*

The excavating apparatus 1*b* is configured such that the bits 41, . . . according to the excavating bit member 2 are impact driven (i.e., they move up and down or advance and retract) not simultaneously but rather staggered in time. The following text explains in detail the constituent members of the excavating apparatus 1*b* and the points of difference from the other embodiments.

Excavating Bit Member 2

Refer now to FIG. 15. In addition to the center piston case member 22*a* mentioned above, the excavating bit member 2 is provided with the five peripheral piston case members 22*b*, . . . . Furthermore, with regard to the center piston case member 22*a* and the other five peripheral piston case members 22*b*, . . . , the lengths of piston case main bodies 220*a*, 220*b* differ and the sizes of the pistons 61, 61*b* housed in the piston case main bodies 220*a*, 220*b* also differ.

Namely, the length in the longitudinal directions of the piston case main body 220*b* of the peripheral piston case member 22*b* shown in, for example, FIG. 15(*b*) is shorter than that of the piston case main body 220*a* of the center piston case member 22*a* shown in FIG. 15(*a*). Namely, a distance L2 from the air distributor 64 to the bit 42*a* shown in FIG. 15(*b*) is shorter than a distance L1 from the air distributor 64 to the bit 41 shown in FIG. 15(*a*).

Furthermore, corresponding to the length of the piston case main body 220*b*, the length in the longitudinal directions of the piston 61*b* of the peripheral piston case member 22*b* shown in FIG. 15(*b*) is shorter than that of the piston 61 of the center piston case member 22*a* shown in FIG. 15(*a*). In other words, the piston 61*b*, which is shorter than the piston 61, also weighs less than the piston 61.

Adopting such a configuration of the piston case members 22*a*, 22*b* means that even if the same amounts of air were fed from the air storage part 30 shown in FIG. 14 to each of the air hoses 351, 352, the piston 61*b* of the peripheral piston case member 22*b* shown in FIG. 15(*b*) will be able to be driven with a smaller amount of air. Accordingly, the number of strikes per unit of time of the peripheral piston case member 22*b* shown in FIG. 15(*b*) is greater than that of the center piston case member 22*a* shown in FIG. 15(*a*).

For example, assuming that the center piston case member 22*a* shown in FIG. 15(*a*) impact drives the bit 41 approximately 1,200 times per minute, then the peripheral piston case member 22*b* shown in FIG. 15(*b*) can be set to the state wherein the bit 42*a* is impact driven approximately 200 strikes per minute more, namely, 1,400 times per minute.

Furthermore, although not shown, the lengths of each of the remaining four peripheral piston case members 22*b*, . . . corresponding to the other bits 42*a*, 42*c*, 42*d*, 42*e* differ, and the sizes of each of the pistons housed therein also differ. Thereby, the number of strikes per minute also differs among them (e.g., the bit 42*a* can be set to 1,600 times per minute, the bit 42*c* can be set to 1,800 times per minute, the bit 42*d* can be set to 2,000 times per minute, and the bit 42*e* can be set to 2,200 times per minute). As a result, the six bits 41, . . . shown in FIG. 1 move up and down not simultaneously but rather staggered in time, and therefore the soil foundation can be excavated.

Furthermore, even if the same bit is used, the number of strikes per unit of time of the bits 41, . . . varies with the hardness of the stratum to be excavated. In the case of a hard stratum, after the soil foundation is struck, the bits 41, . . . return quickly and the subsequent up and down movement of the piston 61 becomes intense; consequently, the number of strikes of each of the bits 41, . . . increases.

As shown in FIG. 14, the connection body 21 positioned at the base end part of each of the piston case main bodies 220*a*, 220*b* has a hole 211 (not visible in FIG. 3), which constitutes the path of the working fluid; furthermore, the base end side of the connection body 21 is formed in the shape of a protrusion in a cross section. That protruding portion constitutes the insertion part 222, which is mounted to the air tank member 3 by inserting it thereinto. Thus, the air that is fed from the air tank member 3 via the insertion part 222 of the connection body 21 drives the driving means inside each of the piston case members 22*a*, 22*b*.

The piston case casings 232 (refer to FIG. 14), which are long and thin casings with a cylindrical shape, are housed inside the piston case mounting body 23. Each of the piston case casings 232 is attached such that the corresponding piston case main body 220*a*, 220*b* is inserted therein. The piston case casings 232 number the same as the piston case main bodies 220*a*, 220*b* and are provided such that their axial directions are oriented in the longitudinal directions of the piston case mounting body 23.

An air gap portion formed between each of the piston case main bodies 220*a*, 220*b* inside the piston case mounting body 23 (i.e., the tubular main body 231) is filled with sand 230 (refer to FIG. 2), which serves as a vibration isolating and/or sound insulating material.

The tip part of each of the piston case main bodies 220*a*, 220*b* partly protrudes from the tip part cover body 233. The base end sides of the substantially tubular drive chucks 24 shown in FIG. 3 are attached such that they are somewhat tightly pushed into holes (symbol omitted) of these protruding portions. The base sides of the bits 41, . . . are retractably accommodated in tip side holes 241 of the drive chucks 24 via the chuck guide 25.

The other end parts (i.e., the upper end parts in FIG. 14) of the air hoses 351, 352 are connected to the compartment holes 3*a*, 3*d*, 3*f*, which are distribution holes formed in the above-mentioned compartment body 300 wherethrough the working fluid is distributed (in FIG. 14, three compartment holes are shown, and the symbols for the remaining three compartment holes not shown are omitted). The compartment holes 3*a*, . . . and the air hoses 351, 352 constitute working fluid distribution parts for feeding the working fluid to the piston case members 22*a*, 22*b*.

In the present embodiment, each of the compartment holes 3*a* is a circular hole. The compartment holes 3*a* are provided such that they correspond to the number of piston case members 22*a*, 22*b*. Namely, the compartment hole 3*f* (hereinbelow, sometimes called the "center compartment hole 3*f*") is provided in one location at the center part of the compartment body 300; furthermore, the compartment holes 3*a*, 3*d*, 3*f*, . . . (hereinbelow sometimes called the "peripheral compartment holes 3*a*") are provided in five locations equispaced along a circumference whose center is the center compartment hole 3*f*.

The air hose 351 (refer to FIG. 14; hereinbelow, called the "center air hose 351"), which leads out from the center piston case member 22*a* that corresponds to the center bit 41 shown in FIG. 1, is connected to the center compartment hole 3*f*. The remaining peripheral compartment holes 3*a*, . . . that surround the center compartment hole 3*f* are connected to the air hoses 352 (refer to FIG. 14; hereinbelow, called the "peripheral air hoses 352"), which lead out from the piston case members 22*b* that correspond to the peripheral bits 42*a*, . . . shown in FIG. 1. The center air hose 351 and the peripheral air hoses 352 all have the same inner diameter and length.

Air Guide Member 8*a*

An air guide member 8*a*, which is a working fluid guide member for guiding the air supplied from the coupling joint 34 to each of the compartment holes 3*a*, . . . of the compartment body 300, is provided inside the air storage part 30. As shown in FIG. 16, the air guide member 8*a* is formed in the shape of a cup (i.e., a saké cup).

The air guide member 8*a* includes: the air guide receptacle 81, which has a semispherical shape (i.e., the shape of half a ball) and that catches the air from the blow-out hole 340 of the coupling joint 34; and a rotary body housing 82*a* that comprises a conical wall part, which is a substantially conical body, that supports the air guide receptacle 81. In the present embodiment, a base end part 823 (in FIG. 14, the lower end part) of the rotary body housing 82*a* is fixed to the compartment body 300 in the vicinity of the circumferential edge part of the compartment body 300, but the base end part 823 can also be directly or indirectly fixed to an inner wall surface 304 of the air storage part 30.

A required number of the intake holes 821, each of which is an intake part that takes air into the interior of the rotary body housing 82*a*, is provided to the rotary body housing 82*a* shown in FIG. 16. The required number of the intake holes 821 (in the present embodiment, a plurality) is provided equispaced (at eight locations) along the circumferential surface directions of the rotary body housing 82*a* near the tip part side (in FIG. 16, the upper side) and near the base side (in FIG. 16, the lower side) of the rotary body housing 82*a*. Each of the intake holes 821 is provided inclined in the diagonally downward direction in FIG. 14 such that it discharges toward the compartment holes 3*a*, . . . of the compartment body 300.

Based on such a configuration, the air supplied from the blow-out hole 340 of the coupling joint 34, shown in the upper part of FIG. 14, strikes the air guide receptacle 81 of the air guide member 8*a*, then rebounds along the recessed part surface of the air guide receptacle 81, returns to the rotary body housing 82*a* side along an arcuate path, emerges via the intake holes 821, and is fed to each of the compartment holes 3*a*, . . . of each of the compartment body 300.

Operation

The operation of the rotary excavator 6, which includes the excavating apparatus 1*b*, will now be explained. Furthermore, explanations of portions of the operation that are in principle the same as those described in the above embodiments will be omitted.

In addition, both the method of setting up the rotary excavator 6 and the procedure leading up to the start of work are the same as those in the above embodiments, and therefore the explanations thereof are omitted; the following text explains the operation after the point in time at which the air is fed from the supply pipe 72 to the excavating apparatus 1*b*.

The air fed from the supply pipe 72 is fed to the excavating apparatus 1*b* via the air supply pipe of the kelly rod 7. The air fed to the excavating apparatus 1*b* is discharged from the blow-out hole 340 of the coupling joint 34, which is shown in FIG. 2, and stored in the air storage part 30.

The air supplied from the blow-out hole 340 strikes the air guide receptacle 81 of the air guide member 8, then rebounds along the recessed part surface of the air guide receptacle 81, returns to the rotary body housing 82*a* side along an arcuate path, emerges via the intake holes 821, and is fed to each of the compartment holes 3*a*, . . . of each of the compartment body 300.

Furthermore, air passes through the air hoses 351, 352 that correspond to the compartment holes 3*a*, . . . , is introduced to the piston case members 22*a*, . . . , drives the pistons 61, 61*b*, . . . , and moves the bits 41, 42*a*, . . . at the tip up and down.

Furthermore, as mentioned above, the lengths of the piston case main bodies 220*a*, 220*b* of the piston case members 22*a* differ and the sizes of the pistons 61*b*, . . . housed in the piston case main bodies 220*a*, 220*b* also differ; consequently, the number of strikes per minute differs. Thereby, the bits 41, 42*a* move up and down staggered in time and do not simultaneously and continually strike the soil foundation. Furthermore, because the diameters of the bits 41, 42 are smaller than that of the hole to be excavated, the impact on the earth surface received with each strike of each of the bits 41, 42 is small.

In addition, as shown in FIG. 14, the driving means, such as the pistons 61 that operate the bits 41, . . . , are housed inside the piston case main bodies 220*a*, 220*b*, are furthermore covered by the tubular piston case casings 232, and are furthermore housed inside the tubular main body 231 that is filled with the sand 230, which is a vibration isolating and/or sound insulating material. Thereby, it is possible to prevent the sound and vibration generated during the drive of the driving means from leaking externally or being transmitted, and therefore to reduce the sound and vibration levels.

Figure 17:
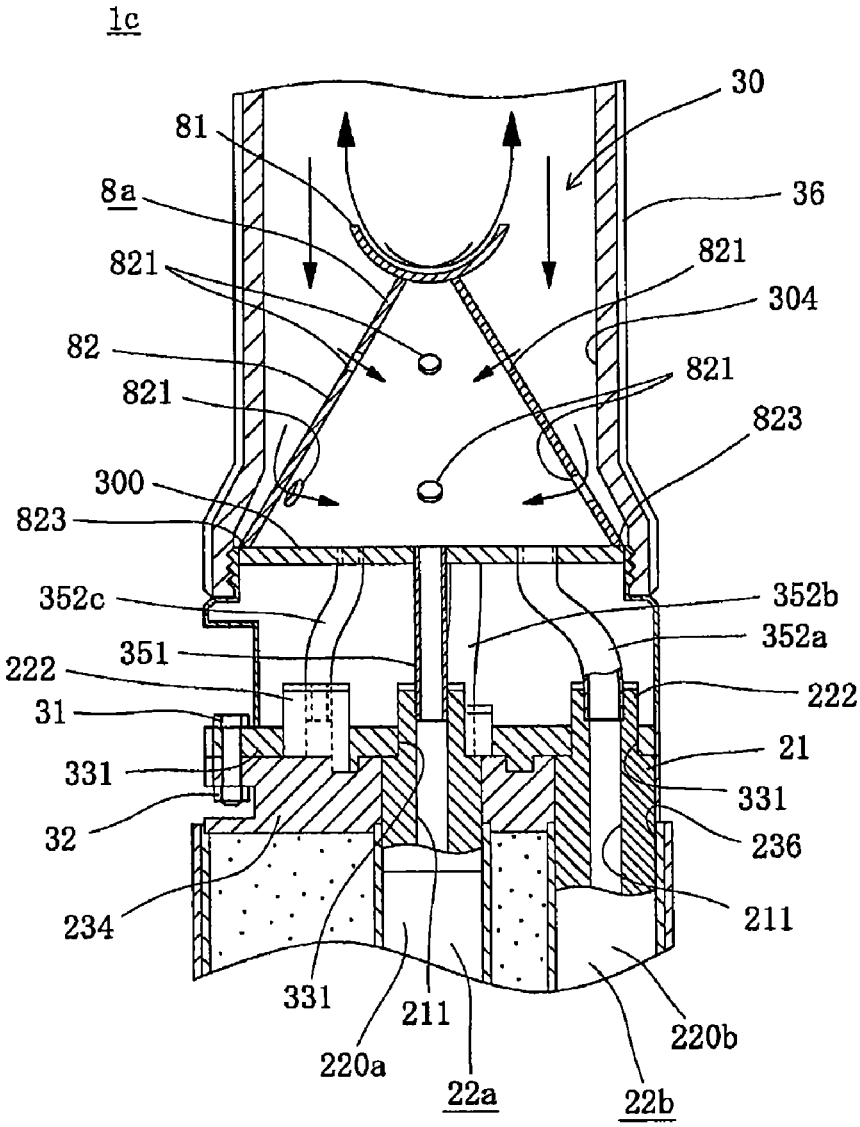
FIG. 17 is an explanatory partial enlarged cross sectional view for explaining the excavating apparatus for underground excavation according to an embodiment.

FIG. 17 is an explanatory partial enlarged cross sectional view for explaining the excavating apparatus for underground excavation according to the present embodiment and, to facilitate understanding of the thicknesses of the air hoses, shows an enlargement of a portion that includes the air hoses.

Furthermore, explanations of portions of the operation described in the above embodiments will be omitted. In addition, the following text omits explanations of locations explained in the above embodiment and principally explains the points of difference.

In the previous embodiment, (refer to FIG. 14), the lengths of the piston case main bodies 220*a*, 220*b* in the piston case members 22*a*, 22*b* differ and the sizes of the pistons 61*b*, . . . housed in the piston case main bodies 220*a*, 220*b* also differ; thereby, the bits 41, . . . are impact driven not simultaneously but rather staggered in time.

In contrast, in an excavating apparatus 1*c* (refer to FIG. 17) according to the present embodiment, while the lengths of the piston case main bodies 220*a*, 220*b*, the sizes of the pistons housed in the piston case main bodies 220*a*, 220*b*, and other conditions remain the same, and all of the same constituent elements are used, there are notable differences regarding whether the piston case members 22*a*, 22*b* comprise the center bit 41 and whether they comprise the peripheral bits 42*a*.

Accordingly, in the present embodiment, the diameters of the air hoses 351, 352*a*, 352*b*, 352*c*, . . . , which are connected to the piston case members 22*a*, 22*b*, vary such that the bits 41, . . . are impact driven not simultaneously but rather staggered in time. Thereby, the arrival times of the air introduced from the air storage part 30 to each of the piston case members 22*a*, 22*b* are staggered, and, as a result, the times at which the bits 41, . . . are impact driven are also staggered.

Furthermore, the arrival times of the air introduced to the piston case members 22*a*, 22*b* may be staggered by varying both the diameters and the lengths of the air hoses 351, 352*a*, 352*b*, 352*c*, . . . .

Other operational aspects and effects are the same as or substantially the same as those in the above embodiment, and consequently the explanations thereof are omitted.

Furthermore, the terms and expressions used in the present specification are merely for the sake of the explanation made herein, and the present invention is not limited thereto; for example, terms and expressions equivalent to those mentioned above are not excluded from the present invention. In addition, the present invention is not limited to the illustrated embodiments, and it is understood that variations and modifications may be effected without departing from the scope of the invention's technical concept.

Furthermore, while including in parenthesis in the claims reference numerals used in the drawings aids in understanding the content of the claims, the scope of the claims is not limited to those symbols used in the drawings.

(a) According to the excavating apparatus of the present invention, at least one aspect selected from the group consisting of the distance of travel of the piston that moves reciprocatively to impart a strike force to the bit, the size of the piston, and the weight of the piston, is set differently for each of the piston case members, or the inner diameter of the working fluid paths through which the working fluid passes is set differently for each of the piston case members; therefore, by setting other conditions of the piston case members identically, the bits are impact driven staggered in time.

Thereby, the impact on the soil foundation received for each strike of the bits is small compared with the conventional down-the-hole hammer, wherein the soil foundation is struck by moving up and down a hammer bit whose diameter is substantially the same as that of the hole to be excavated; consequently, excavation work can be performed with low levels of vibration and noise. Accordingly, the present invention is suitable for use in, for example, dense residential areas and urban business districts where it is desirable to perform work at lower levels of vibration and noise.

In addition, in contrast to the conventional excavating apparatus, which requires a comparatively large air compressor, the present invention needs only to drive comparatively small bits, and therefore the amount of the working fluid (e.g., air) required for a single bit to advance and retreat is small, which enables the supply apparatus that supplies the working fluid (e.g., the air compressor when the working fluid is air) to be made more compact. Thereby, only a small installation surface area is needed for the supply apparatus, and consequently the present invention is ideally suited to construction work performed at locations where space is limited, such as dense residential areas and urban business districts. In addition, reducing the size of the supply apparatus makes it possible to make the driving means, such as the engine that drives the supply apparatus, more compact; consequently, it is possible to reduce the levels of vibration and noise generated by the driving means.

(b) By providing the rotary body with working fluid receiving blades that catch the working fluid and thereby rotate the rotary body, the rotary body itself rotates without the addition of any other motive power; consequently, it is possible to prevent problems such as complicating the structure or increasing the number of parts as in cases wherein other types of motive power are provided.

(c) The rotary body includes working fluid supply holes, which bring the fluid storage part and the distribution ports into communication separately from the communication holes, and therefore the bits can be impact driven promptly; consequently, the excavation work can be performed smoothly.

(d) A plurality of bits are provided, separately and independently of the bits that are impact driven staggered in time, that are impact driven simultaneously, and therefore the plurality of bits that are impact driven simultaneously can simultaneously impart a large impact force to the earth surface, yielding a high excavation working efficiency. In addition, also provided are the plurality of bits that are impact driven staggered in time, which, compared with the case wherein all of the bits are impact driven staggered in time, makes it possible to reduce the number of construction work days needed to perform the excavation work.

(e) The working fluid guide member is provided to the fluid storage part, and therefore it is possible to prevent nonuniformity in the working fluid that is fed to each of the piston case members; consequently, the impact forces of every bit are made identical, or identical to the degree possible, and the excavation surface can be struck evenly.

(f) The excavating apparatus main body is provided with a vibration isolating and/or sound insulating material that surrounds the piston cases, which makes it possible to effectively prevent the leakage or external transmission of the vibration or the sound generated when the pistons are driven.

(g) According to the rotary excavator and the underground excavating method of the present invention, using the excavating apparatus, which has the effects mentioned above, while imparting rotary motion thereto makes it possible to perform excavation work at low levels of vibration and noise.

What is claimed is:

1. The excavating apparatus for underground excavation, comprising:

a plurality of bits, the outer diameters of which are smaller than that of an excavating apparatus main body, that advances to and retracts from an excavation side;

piston case members, which correspond to the number of the bits and a plurality of which are housed inside the excavating apparatus main body, with built-in pistons that impart strike forces to the bits via the energy of a working fluid;

a fluid storage part that stores the working fluid that is fed to each of the piston case members;

working fluid distribution paths, a plurality of which are provided corresponding to the number of the piston case members, wherethrough the working fluid fed to each of the piston case members passes; and a rotary body that comprises a plurality of communication holes, which brings the fluid storage part and distribution ports into communication in order to feed the working fluid from the fluid storage part to the distribution ports of the working fluid distribution paths; wherein, the distribution ports are provided in the rotational direction of the rotary body such that the bits are impact driven staggered in time; and the communication holes are provided in the rotational direction with a layout different from that of the distribution ports in order to prevent each of the communication holes from communicating with each of the distribution ports simultaneously and with the same degree of openness wherein, the rotary body comprises working fluid supply holes that, separately from the communication holes, bring the fluid storage part and each of the distribution ports into communication; and the working fluid supply holes are set such that their inner diameters are smaller than those of the communication holes, said working fluid being fed through said supply holes into each of the piston case members in an amount smaller than that which is fed through the distribution ports.

2. The excavating apparatus for underground excavation according to claim 1, wherein the rotary body comprises a working fluid receiving blade for catching the working fluid and thereby rotating the rotary body.

3. The excavating apparatus for underground excavation according to claim 1, comprising:

a plurality of bits that are impact driven simultaneously separately and independently of the plurality of the bits that are impact driven staggered in time; wherein, the working fluid distribution paths of piston case members that correspond to the separately and independently driven bits are in a state of continuous communication with the fluid storage part without being controlled by the rotary body.

4. The excavating apparatus for underground excavation according to claim 1, wherein the fluid storage part is provided with a working fluid guide member that catches the working fluid supplied by the fluid storage part and guides such to the distribution ports.

5. The excavating apparatus for underground excavation according to claim 1, wherein the excavating apparatus main body is provided with vibration isolating and/or sound insulating materials such that they surround the piston case member.

6. The excavating apparatus for underground excavation according to claim 1, further comprising a center communication hole that is formed on the rotary body and is connected to a center fluid hose such that the fluid storage part and the center fluid hose are in continuous communication.

7. The excavating apparatus for underground excavation according to claim 1, wherein the working fluid is air.

8. A rotary excavator, comprising:

the excavating apparatus according to claim 1, and a rotary drive apparatus that is capable of imparting rotary motion to the excavating apparatus.

9. An underground excavating method wherein the excavating apparatus according to claim 1 is used, comprising the step of:

performing underground excavation while imparting rotary motion to the excavating apparatus.

* * * * *